US012460627B2

(12) United States Patent
Son

(10) Patent No.: US 12,460,627 B2
(45) Date of Patent: Nov. 4, 2025

(54) TORSION PUMP AND APPARATUS FOR SUPPLYING CHEMICAL LIQUID

(71) Applicant: SEMES CO., LTD., Cheonan-si (KR)

(72) Inventor: Young Jun Son, Cheonan-si (KR)

(73) Assignee: Semes Co., Ltd., Chungcheongnam-do (KR)

( * ) Notice: Subject to any disclaimer, the term of this patent is extended or adjusted under 35 U.S.C. 154(b) by 196 days.

(21) Appl. No.: 18/068,023

(22) Filed: Dec. 19, 2022

(65) Prior Publication Data

US 2023/0197471 A1 Jun. 22, 2023

(30) Foreign Application Priority Data

Dec. 21, 2021 (KR) ..... 10-2021-0184207

(51) Int. Cl.
*F04B 43/08* (2006.01)

(52) U.S. Cl.
CPC ..... *F04B 43/08* (2013.01)

(58) Field of Classification Search
CPC ..... F04B 43/08; F04B 43/084
USPC ..... 417/474, 478
See application file for complete search history.

(56) References Cited

U.S. PATENT DOCUMENTS 4,540,350 A * 9/1985 Streicher ..... F04B 43/1253 417/475
2018/0147123 A1* 5/2018 Sacchetti ..... B65H 54/04
2020/0290080 A1* 9/2020 Naitou ..... B05C 11/1005

FOREIGN PATENT DOCUMENTS

EP 0099967 A1 * 2/1984 ..... F04B 43/084
FR 1156026 A 5/1958
JP 3899738 B2 3/2007
KR 101967217 B1 4/2019
WO WO-2016077751 A1 * 5/2016 ..... F04B 43/0054

OTHER PUBLICATIONS

Office Action issued Mar. 13, 2025 in Chinese Application No. 202211651453.1.

* cited by examiner

*Primary Examiner* — Essama Omgba
*Assistant Examiner* — Dnyanesh G Kasture
(74) *Attorney, Agent, or Firm* — Harness, Dickey & Pierce, P.L.C.

(57) ABSTRACT

The present invention provides a pump for supplying a liquid. The pump comprises: a tube member having a hose communicating with a chemical liquid inlet and a chemical liquid outlet, and a cylindrical drum provided to wind the hose, and configured to discharge a chemical liquid through a volume change caused by contraction of the hose wound around the drum; and a driver configured to provide a rotational force such that the hose is wound around the drum.

15 Claims, 22 Drawing Sheets

TORSION PUMP AND APPARATUS FOR SUPPLYING CHEMICAL LIQUID

CROSS-REFERENCE TO RELATED APPLICATIONS

This application claims priority to and the benefit of Korean Patent Application No. 10-2021-0184207 filed in the Korean Intellectual Property Office on Dec. 21, 2021, the entire contents of which are incorporated herein by reference.

TECHNICAL FIELD

The present invention relates to a torsion pump and an apparatus for supplying a chemical liquid with the torsion pump.

BACKGROUND ART

In order to manufacture a semiconductor device or a liquid crystal display, a variety of processes such as photography, etching, ashing, ion implantation, thin film deposition, and cleaning are performed on a substrate. Among them, in the photographic, etching, ashing, and cleaning processes, a liquid processing process for supplying a liquid to a substrate is carried out.

In general, the liquid processing process is a process of discharging a processing liquid from a nozzle and processing a substrate with liquid.

A various pumps are used in a chemical liquid supply device of the liquid processing process. Among them, it is difficult for a mini pump to be applied to fine process facilities (e.g., ArF, EUV facilities, etc.) because a stagnant photosensitive solution (PR) due to poor chemical substitution rate may result in many particles.

SUMMARY OF THE INVENTION

The present invention has been made in an effort to provide a torsion pump and an apparatus for supplying a chemical liquid which can improve a chemical substitution rate.

The present invention has also been made in an effort to provide a torsion pump and an apparatus for supplying a chemical liquid in which the size thereof can be reduce.

The object of the present invention is not limited thereto, and other objects not mentioned will be clearly understood by those of ordinary skill in the art from the following description.

An exemplary embodiment of the present invention provides torsion pump, including: a tube member having a hose communicating with a chemical liquid inlet and a chemical liquid outlet, and a cylindrical drum provided to wind the hose, and configured to discharge a chemical liquid through a volume change caused by contraction of the hose wound around the drum; and a driver configured to provide a rotational force such that the hose is wound around the drum.

According to the exemplary embodiment, the tube member includes: a first flange configured to support one end of the drum; and a second flange configured to support the other end of the drum, and one end of the hose is connected to the first flange, and the other end of the hose is connected to the second flange, and the second flange is connected to the driver and rotated.

According to the exemplary embodiment, the first flange is provided with the chemical liquid inlet, and a first inner flow path connecting the chemical liquid inlet and one end of the hose, and the second flange is provided with the chemical liquid outlet and a second inner flow path connecting the chemical liquid outlet and the other end of the hose.

According to the exemplary embodiment, the tube member is provided with a plurality of hoses, and the hoses are wound in the same direction, and the hoses are provided with a chemical liquid from different chemical liquid sources and are combined into one hose before discharging the chemical liquid to the chemical liquid outlet.

According to the exemplary embodiment, the hose is provided while being wound around the drum in a coil shape.

According to the exemplary embodiment, the hose is wound around the drum in a coil shape by a winding operation of the driver.

According to the exemplary embodiment, the torsion pump further comprises a sealing case provided between the first flange and the second flange such that the drum and the hose are blocked from an external environment.

According to the exemplary embodiment, an interior of the sealing case is filled with incompressible fluid, and the sealing case is provided in the form of bellows.

According to the exemplary embodiment, the drum is made of a flexible material, the drum provides an inner space connecting the chemical liquid inlet and the chemical liquid outlet, and is twisted by a rotation of the second flange, and the chemical liquid can be discharged through a volume change due to the twisting.

According to the exemplary embodiment, the driver further includes a compensation member configured to compensate for a vertical length deformation caused by a twisting operation of the tube member.

According to the exemplary embodiment, the compensation member includes a ball screw, and the second flange can rotate and move up and down on the ball screw.

Another exemplary embodiment of the present invention provides an apparatus for supplying a chemical liquid, the apparatus including: a pump configured to supply a chemical liquid to a nozzle that discharges the chemical liquid to a substrate; a trap tank in which the chemical liquid to be supplied from the pump to the nozzle is temporarily stored; a bottle containing the chemical liquid stored in the trap tank; a filter provided on a path through which the chemical liquid is supplied from the trap tank to the pump, and the pump includes: a tube member having at least one hose communicating with a chemical liquid inlet and a chemical liquid outlet, and a cylindrical drum provided to wind the hose, and configured to discharge a chemical liquid through a volume change caused by contraction of the hose wound around the drum; and a driver configured to provide a rotational force such that the hose is wound around the drum.

According to the exemplary embodiment, the tube member includes: a first flange configured to support one end of the drum; and a second flange configured to support the other end of the drum, and one end of the hose is connected to the first flange, and the other end of the hose is connected to the second flange, and the second flange is connected to the driver and rotated.

According to the exemplary embodiment, the first flange is provided with the chemical liquid inlet, and a first inner flow path connecting the chemical liquid inlet and one end of the hose, and the second flange is provided with the chemical liquid outlet and a second inner flow path connecting the chemical liquid outlet and the other end of the hose.

According to the exemplary embodiment, the hose is provided while being wound around the drum in a coil shape, or is provided to be wound around the drum in a coil shape by a winding operation of the driver.

According to the exemplary embodiment, the apparatus for supplying a chemical liquid further comprises a sealing case provided between the first flange and the second flange such that the drum and the hose are blocked from an external environment.

According to the exemplary embodiment, an interior of the sealing case is filled with incompressible fluid, and the sealing case is provided in the form of bellows.

According to the exemplary embodiment, the drum is made of a flexible material, the drum provides an inner space connecting the chemical liquid inlet and the chemical liquid outlet, and is twisted by a rotation of the second flange, and the chemical liquid can be discharged through a volume change due to the twisting.

According to the exemplary embodiment, the driver further includes a compensation member configured to compensate for a vertical length deformation caused by a twisting operation of the tube member.

Another exemplary embodiment of the present invention provides a torsion pump, including: a tube member having a hose communicating with a chemical liquid inlet and a chemical liquid outlet, and a cylindrical drum provided to wind the hose, and configured to discharge a chemical liquid through a volume change caused by contraction of the hose wound around the drum; and a driver configured to provide a rotational force such that the hose is wound around the drum, and the tube member includes: a first flange configured to support one end of the drum; and a second flange configured to support the other end of the drum and connected to the driver and rotated, and the torsion pump further comprises a sealing case provided between the first flange and the second flange such that the drum and the hose are blocked from an external environment, one end of the hose is connected to the first flange, and the other end of the hose is connected to the second flange, the first flange is provided with the chemical liquid inlet, and a first inner flow path connecting the chemical liquid inlet and one end of the hose, and the second flange is provided with the chemical liquid outlet, and a second inner flow path connecting the chemical liquid outlet and the other end of the hose.

According to the exemplary embodiment of the invention, it is possible to improve a chemical substitution rate.

Further, according to the exemplary embodiment of the present invention, it is possible to reduce a torsion pump.

The effect of the present invention is not limited to the foregoing effects, and the not-mentioned effects will be clearly understood by those skilled in the art from the present specification and the accompanying drawings.

DETAILED DESCRIPTION

Advantages and features of the present invention and methods for achieving them will be apparent with reference to the embodiments described below in detail with the accompanying drawings. However, the present invention is not limited to the embodiments disclosed below, but will be implemented in various forms, and only the present embodiments are intended to complete the disclosure of the present invention, and the general knowledge in the art to which the present invention pertains. It is provided to fully convey the scope of the invention to those skilled in the art, and the present invention is defined only by the scope of the claims.

If not defined, all terms used herein (including technical or scientific terms) have the same meaning as commonly accepted by universal techniques in the prior art to which this invention belongs. Terms defined by general dictionaries may be interpreted as having the same meaning as in the related description and/or text of the present application, and are not conceptualized or overly formal, even if not expressly defined herein. The terminology used herein is for the purpose of describing particular embodiments only and is not intended to be limiting of the invention.

In this specification, the singular also includes the plural unless specifically stated otherwise in the phrase. It will be further understood that the terms 'comprises,' 'comprising,' 'includes,' and/or 'including,' when used herein, specify the presence of stated features, integers, steps, operations, elements, and/or components, but do not preclude the presence or addition of one or more other features, integers, steps, operations, elements, components, and/or groups thereof.

It is described that the facility in one embodiment of the present invention is used to perform a photolithography process on a substrate such as a semiconductor wafer or a flat panel, but this is for convenience of explanation, and the present invention can also be used in other devices that use a pump for supplying chemical liquids to process a substrate.

Hereinafter, one embodiment of the present invention will be described with reference to FIGS. 1 to 22.

Figure 1:
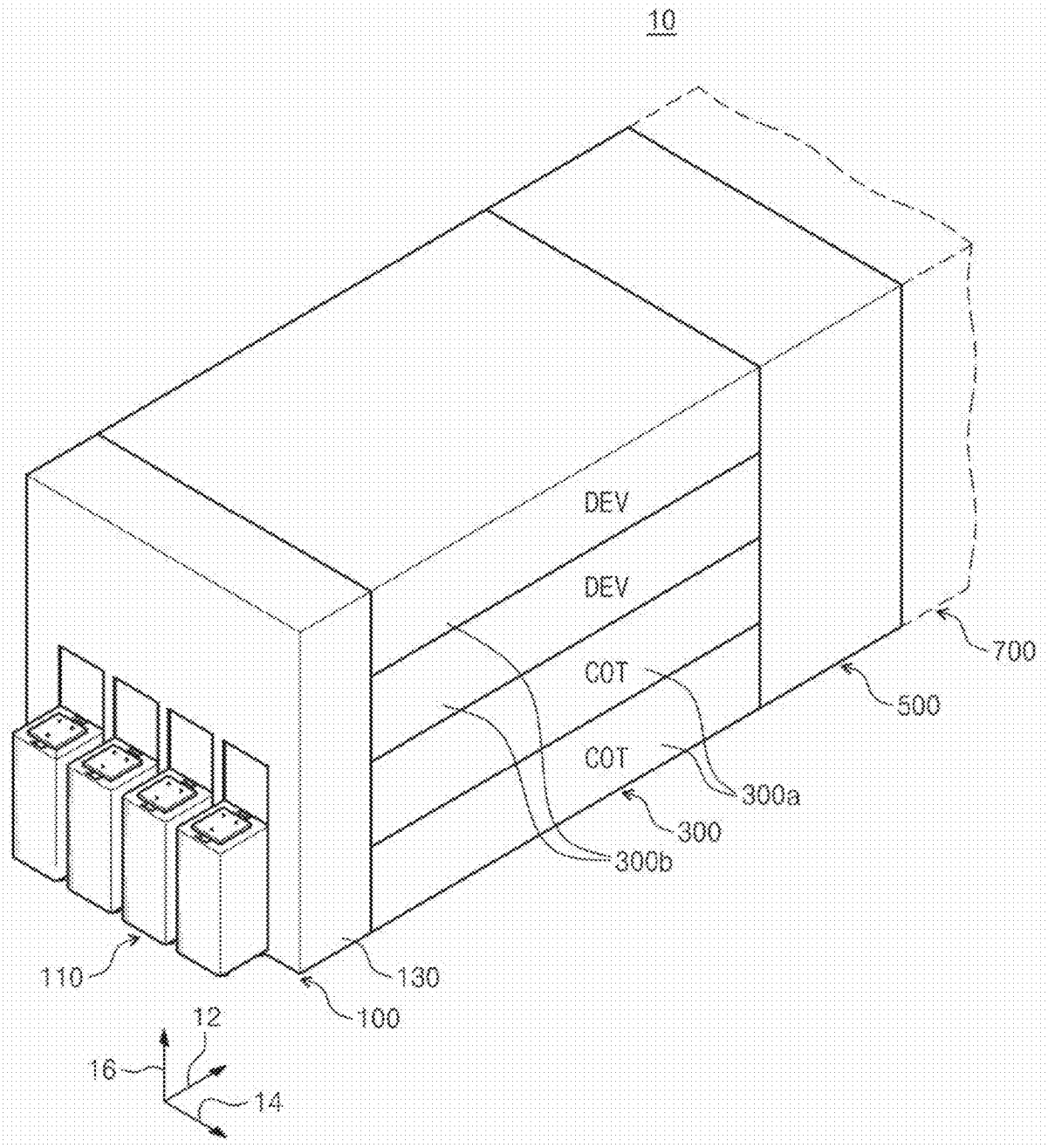
FIG. 1 is a perspective view schematically illustrating a substrate processing apparatus according to the exemplary embodiment of the present invention.
Figure 2:
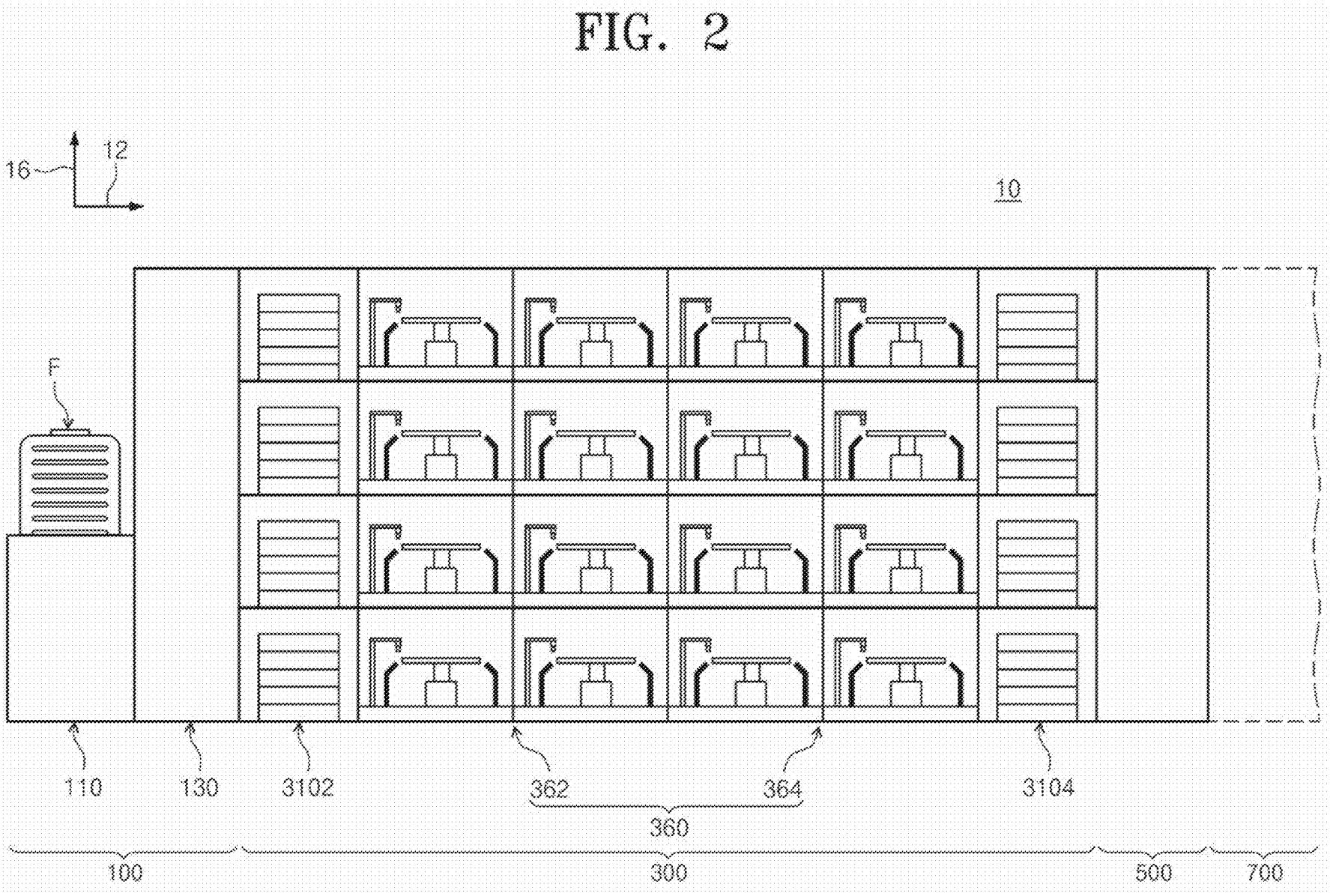
FIG. 2 is a cross-sectional view of the substrate processing apparatus showing a coating block or a development block of FIG. 1.
Figure 3:
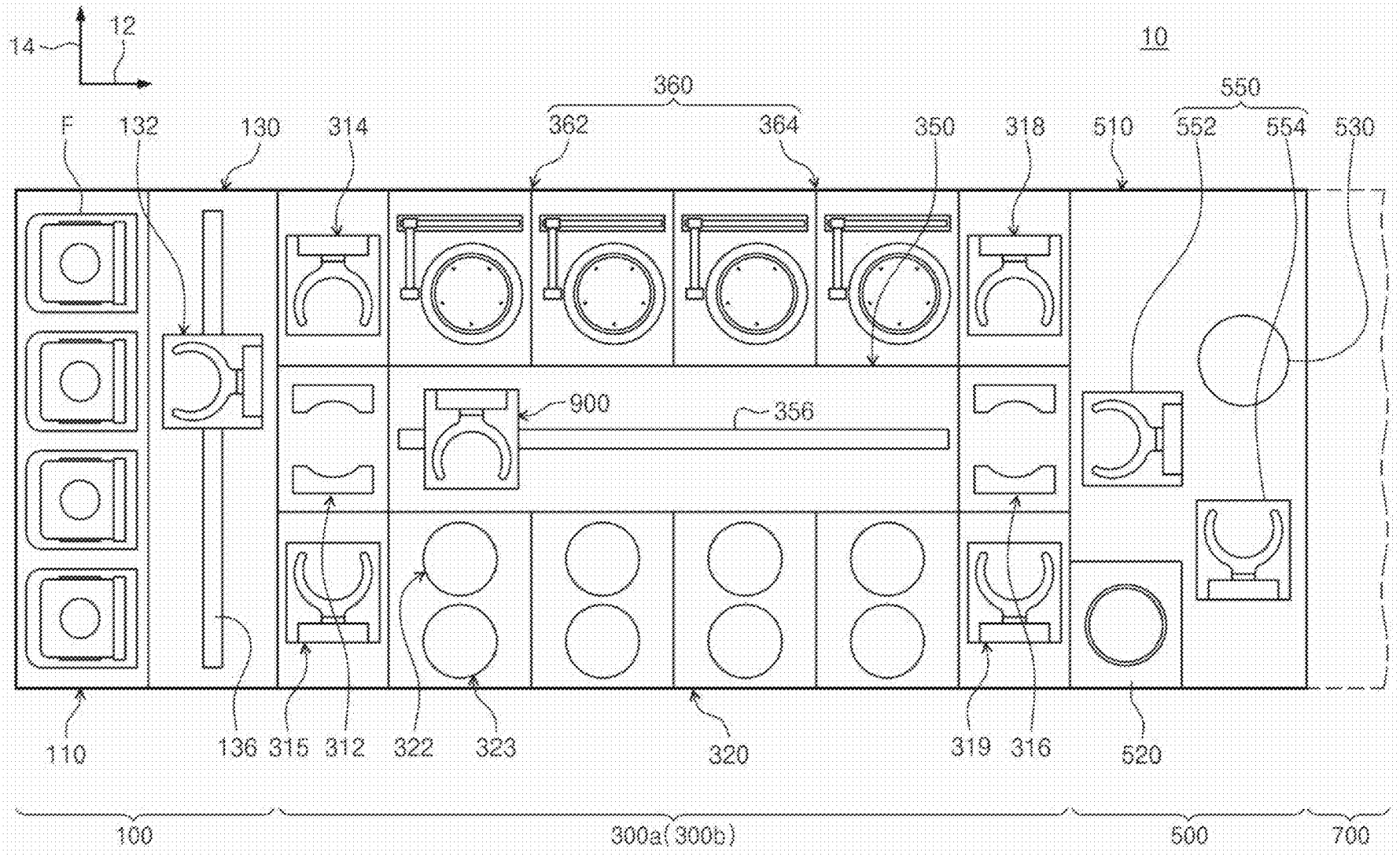
FIG. 3 is a top plan view of the substrate processing apparatus of FIG. 1.

FIG. 1 is a perspective view schematically illustrating a substrate processing apparatus according to the exemplary embodiment of the present invention, FIG. 2 is a cross-sectional view of the substrate processing apparatus showing an coating block or a development block of FIG. 1, and FIG. 3 is a top plan view of the substrate processing apparatus of FIG. 1.

Referring to FIGS. 1 to 3, a substrate processing apparatus 10 according to one embodiment of the present invention includes an index module 100, a processing module 300, and an interface module 500.

According to the exemplary embodiment, the index module 100, the processing module 300, and the interface module 500 are sequentially arranged in a line. Hereinafter, a direction in which the index module 100, the processing module 300, and the interface module 500 are arranged refers to a first direction 12, a direction perpendicular to the first direction 12 when viewed from the top refers to a second direction 14, and a direction perpendicular to both the first direction 12 and the second direction refers to a third direction 16.

The index module 100 transfers a substrate W to the processing module 300 from a container F in which the substrate W is accommodated, and accommodates the processed substrate W in the container F. A longitudinal direction of the index module 100 is provided in the second direction 14. The index module 100 has a load port 110 and an index frame 130. The load port 110 is disposed on a side opposite to the processing module 300 based on the index frame 130. The container F in which the substrates W are accommodated is placed in the load port 110. A plurality of load ports 110 may be provided, and the plurality of load ports 110 may be disposed in the second direction 14.

A sealing container F such as a front open unified pod (FOUP) may be used as the container F. The container F may be placed in the load port 110 by an or operator or a transfer means (not illustrated), such as an overhead transfer, an overhead conveyor, or an automatic guided vehicle.

An index robot 132 is provided inside the index frame 130. A guide rail 136 of which the longitudinal direction is provided as the second direction 14 may be provided within the index frame 130, and the index robot 132 may be provided to be movable on the guide rail 136. The index robot 132 includes a hand on which the substrate W is placed, and the hand may be provided to move forward and backward, rotate around the third direction 16 as an axis, and move in the third direction 16.

The processing module 300 may perform a coating process and a development process on the substrate W. The processing module 300 may receive the substrate W accommodated in the container F to perform a substrate processing process. The processing module 300 has a coating block 300*a* and a development block 300*b*. The coating block 300*a* performs the coating process on the substrate W, and the development block 300*b* performs the development process on the substrate W. A plurality of coating blocks 300*a* are provided, and the plurality of coating blocks 300*a* are provided to be stacked on each other. A plurality of development blocks 300*b* are provided, and the plurality of development blocks 300*b* are provided to be stacked on each other. According to the exemplary embodiment of FIG. 1, two coating blocks 300*a* and two development blocks 300*b* are provided. The coating blocks 300*a* may be disposed below the development blocks 300*b*. According to the exemplary embodiment, the two coating blocks 300*a* may perform the same process and may be provided in the same structure. In addition, the two development blocks 300*b* perform the same process and may be provided in the same structure.

Referring to FIG. 3, the coating block 300*a* has a heat processing chamber 320, a transfer chamber (350), a liquid processing chamber 360, and buffer chambers 312 and 316. The heat processing chamber 320 performs a heat processing process on the substrate W. The heat processing process may include a cooling process and a heating process. The liquid processing chamber 360 supplies a liquid to the substrate W to form a liquid film. The liquid film may be a photoresist film or an antireflection film. The transfer chamber 350 transfers the substrate W between the heat processing chamber 320 and the liquid processing chamber 360 in the coating block 300*a*.

A longitudinal direction of the transfer chamber 350 is provided in parallel with the first direction 12. A transfer robot 900 is provided in the transfer chamber 350. The transfer robot 900 transfers the substrate between the heat processing chamber 320, the liquid processing chamber 360, and the buffer chambers 312 and 316. According to one embodiment, the transfer robot 900 has a hand on which the substrate W is placed, and the hand may be provided to move forward and backward, rotate around the third direction 16, and move in the third direction 16. A guide rail 356 of which the longitudinal direction is provided in parallel with the first direction 12 may be provided in the transfer chamber 350, and the transfer robot 900 may be provided to be movable on the guide rail 356.

Figure 4:
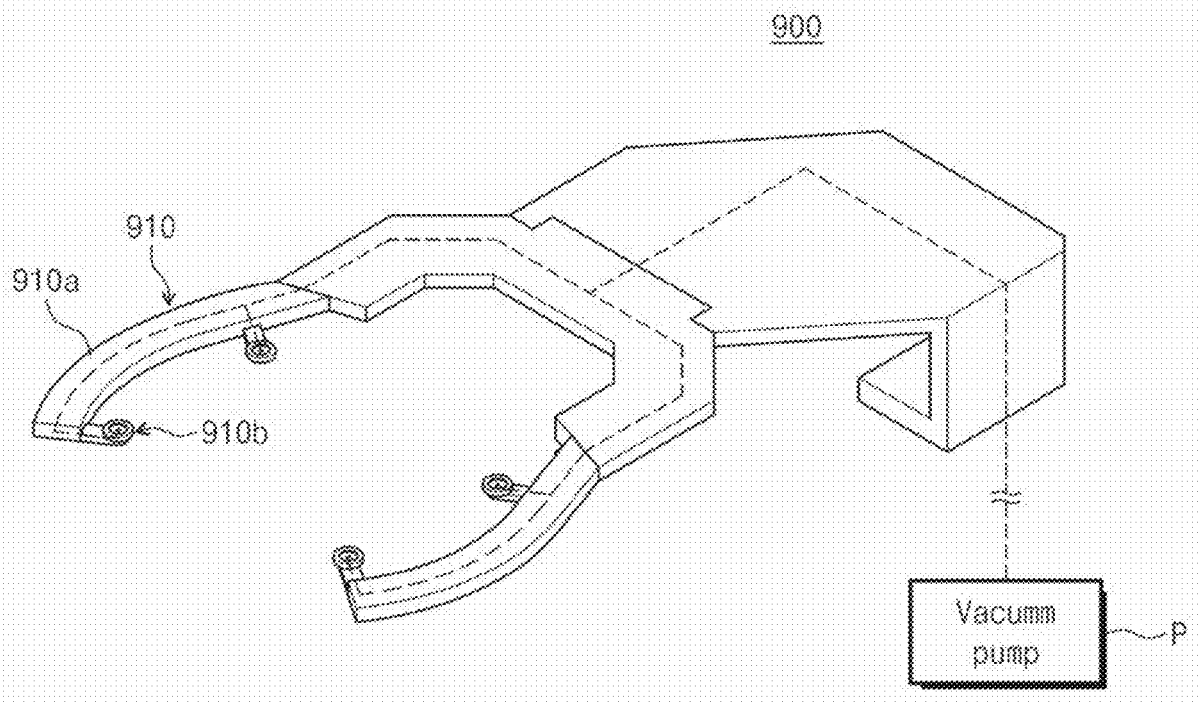
FIG. 4 is a view illustrating an example of a hand of a transfer robot.

FIG. 4 is a view illustrating an example of a hand of a transfer robot.

Referring to FIG. 4, the hand 910 includes a hand body 910*a* and support fingers 910*b*. The hand body 910*a* is formed in a substantially horseshoe shape having an inner diameter larger than the diameter of the substrate. However, the shape of the hand body 910*a* is not limited thereto. The support fingers 910*b* are installed inwardly at four areas including a front end of the hand body 910*a*. A vacuum flow path (not illustrated) is formed therein in the hand body 910*a*. The vacuum flow path (not illustrated) is connected to a vacuum pump through a vacuum line.

Referring back to FIGS. 1 to 3, a plurality of heat processing chambers 320 are provided. The heat processing chambers 320 are disposed in the first direction 12. The heat processing chambers 320 are disposed on one side of the transfer chamber 350.

Figure 5:
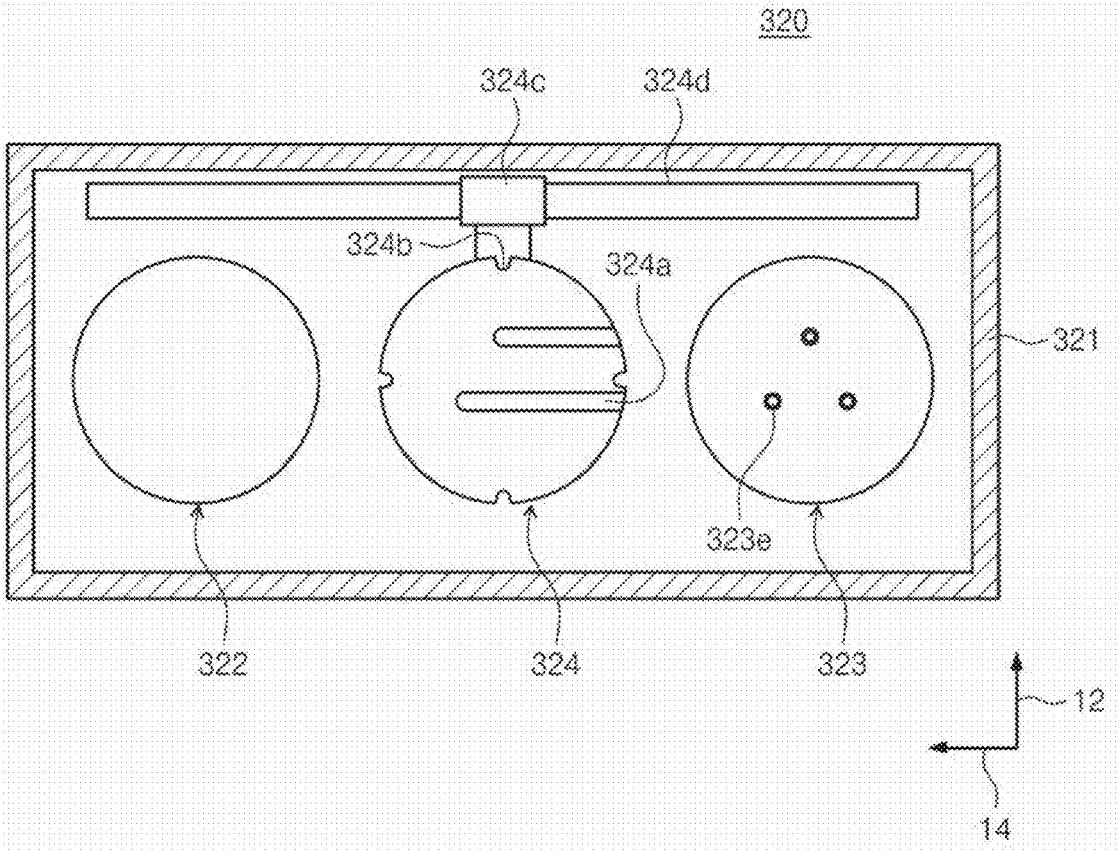
FIG. 5 is a top plan view schematically illustrating one example of a heat processing chamber of FIG. 3.
Figure 6:
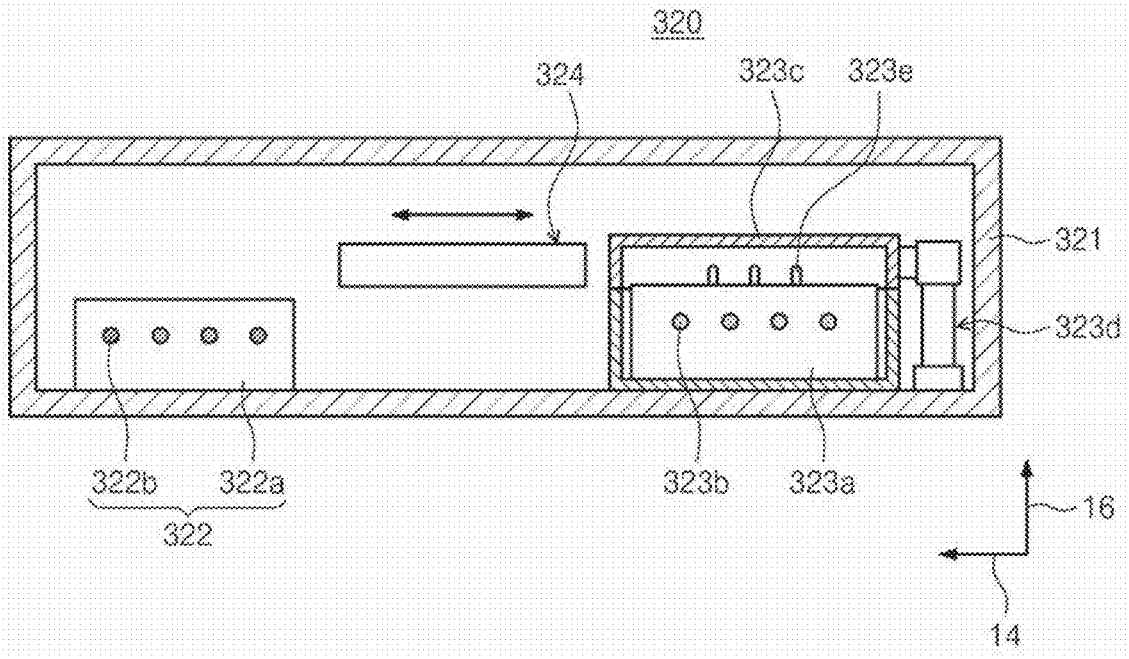
FIG. 6 is a front view of the heat processing chamber of FIG. 5.

FIG. 5 is a top plan view schematically illustrating one example of a heat processing chamber of FIG. 3, and FIG. 6 is a front view of the heat processing chamber of FIG. 5.

Referring to FIGS. 5 and 6, the heat processing chamber 320 has a housing 321, a cooling unit 322, a heating unit 323, and a transfer plate 324.

The housing 321 is provided in a substantially rectangular parallelepiped shape. An entrance (not illustrated) through which the substrate W is carried in and out is formed on a sidewall of the housing 321. The entrance may be kept open. A door (not illustrated) may be provided to selectively open and close the entrance. The cooling unit 322, the heating unit 323, and the transfer plate 324 are provided in the housing 321. The cooling unit 322 and the heating unit 323 are arranged in the second direction 14. According to the exemplary embodiment, the cooling unit 322 may be disposed closer to the transfer chamber 350 than the heating unit 323.

The cooling unit 322 has a cooling plate 322*a*. The cooling plate 322*a* may have a substantially circular shape when viewed from the top. The cooling plate 322*a* is provided with a cooling member 322*b*. According to the exemplary embodiment, the cooling member 322*b* may be formed inside the cooling plate 322*a* and may be provided as a flow path through which a cooling fluid flows.

The heating unit 323 has a heating plate 323*a*, a cover 323*c*, and a heater 323*b*. The heating plate 323*a* has a substantially circular shape when viewed from the top. The heating plate 323*a* has a diameter larger than that of the substrate W. The heater 323*b* is installed in the heating plate 323*a*. The heater 323*b* may be provided as a heating resistor to which current is applied. Lift pins 323*e* capable of being vertically driven in the third direction 16 are provided in the heating plate 323*a*. The lift pin 323*e* receives the substrate W from a transfer means outside the heating unit 323 and puts down the substrate W on the heating plate 323*a* or lifts the substrate W from the heating plate 323*a* and then transfers down to the transfer means outside the heating unit 323. According to one embodiment, three lift pins 323*e* may be provided. The cover 323*c* has an inner space of which the lower part is opened.

The cover 323*c* is disposed in an upper part of the heating plate 323*a* and is moved in the vertical direction by a driver 323*d*. A space in which the cover 323*c* is moved to form the cover 323*c* and the heating plate 323*a* is provided as a heating space for heating the substrate W.

The transfer plate 324 is provided in a substantially disk shape and has a diameter corresponding to that of the substrate W. A notch 324*b* is formed in an edge of the transfer plate 324. The notch 324*b* may have a shape corresponding to a protrusion 3543 formed in the hand 354 of the above-described transfer robot 352. In addition, the notch 324*b* is provided to have a number corresponding to the protrusion 3543 formed in the hand 354, and is formed at a position corresponding to the protrusion 3543. When the upper and lower positions of the hand 354 and the transfer plate 324 are changed at a position where the hand 354 and the transfer plate 324 are vertically aligned, the substrate W is transferred between the hand 354 and the transfer plate 324. The transfer plate 324 is mounted on the guide rail 324*d* and may be moved between a first region 3212 and a second region 3214 along the guide rail 324*d* by a driver 324*c*. A plurality of slit-shaped guide grooves 324*a* are provided in the transfer plate 324. The guide groove 324*a* extends from an end of the transfer plate 324 to the inside of the transfer plate 324. A longitudinal direction of the guide groove 324*a* is provided along the second direction 14, and the guide grooves 324*a* are spaced apart from each other in the first direction 12. The guide groove 324*a* prevent the transfer plate 324 and the lift pin 323*e* from interfering with each other when the substrate W is transferred between the transfer plate 324 and the heating unit 323.

The cooling of the substrate W is performed while the transfer plate 324 on which the substrate W is placed is in contact with the cooling plate 322*a*. The transfer plate 324 is made of a material with high thermal conductivity such that a heat transfer is properly performed between the cooling plate 322*a* and the substrate W. According to one embodiment, the transfer plate 324 may be made of a metal material.

The heating unit 323 provided in some of the heat processing chambers 320 may improve an adhesion rate of a photoresist on the substrate by supplying gas during heating of the substrate W. According to one embodiment, the gas may be a hexamethyldisilane (HMDS) gas.

Referring back to FIGS. 1 to 3, a plurality of liquid processing chambers 360 are provided. Some of the liquid processing chambers 360 may be provided to be stacked with each other. The liquid processing chambers 360 are disposed on one side of the transfer chamber 350. The liquid processing chambers 360 are arranged side by side in the first direction 12. Some of the liquid processing chambers 360 are provided in a position adjacent to the index module 100. Hereinafter, the liquid processing chamber 360 disposed adjacent to the index module 100 refers to a front liquid processing chamber 362. The others of the liquid processing chambers 360 is provided in a position adjacent to the interface module 500. Hereinafter, the liquid processing chamber 360 disposed adjacent to the interlace module 500 refers to a rear liquid processing chamber 364.

The front liquid processing chamber 362 applies a first liquid on the substrate W, and the rear liquid processing chamber 364 applies a second liquid on the substrate W. The first liquid and the second liquid may be different types of liquids. According to the exemplary embodiment, the first liquid is an anti-reflection film, and the second liquid is a photoresist. The photoresist may be applied on the substrate W coated with the anti-reflection film. Alternatively, the first liquid may be a photoresist, and the second liquid may be an anti-reflection film. In this case, the anti-reflection film may be applied on the substrate W coated with the photoresist. Alternatively, the first liquid and the second liquid are the same kind of liquid, and both of them may be photoresist.

The development block 300*b* has the same structure as the coating block 300*a*, and the liquid processing chamber provided in the development block 300*b* supplies a developing solution to the substrate.

The interface module 500 connects the processing module 300 to an external exposure device 700. The interface module 500 has an interface frame 510, an additional process chamber 520, an interface buffer 530, and an interface robot 550.

A fan filter unit that forms a downflow therein may be provided in an upper end of the interface frame 510. The additional process chamber 520, the interface buffer 530, and the interface robot 550 are disposed inside the interface frame 510. The additional process chamber 520 may perform a predetermined additional process before the substrate W on which the process is completed in the coating block 300*a* is taken into the exposure device 700. Alternatively, the additional process chamber 520 may perform a predetermined additional process before the substrate W on which the process is completed in the exposure device 700 is taken into the development block 300*b*. According to the exemplary embodiment, the additional process may include an edge exposure process of exposing an edge region of the substrate W, an upper surface cleaning process of cleaning an upper surface of the substrate W, or a lower surface cleaning process of cleaning a lower surface of the substrate W. A plurality of additional process chambers 520 are provided, and the plurality of additional process chambers 520 may be provided to be stacked on each other. All the additional process chambers 520 may be provided to perform the same process. Alternatively, some of the additional process chambers 520 may be provided to perform different processes.

The interface buffer 530 provides a space in which the substrate W transferred between the coating block 300*a*, the additional process chamber 520, the exposure device 700, and the development block 300*b* temporarily stays during the transfer. A plurality of interface buffers 530 may be provided, and the plurality of interface buffers 530 may be provided to be stacked on each other.

According to the exemplary embodiment, the additional process chamber 520 may be disposed on one side and the interface buffer 530 may be disposed on the other side based on an extension line in the longitudinal direction of the transfer chamber 350.

The interface robot 550 transfers the substrate W between the coating block 300*a*, the additional process chamber 520, the exposure device 700, and the development block 300*b*. The interface robot 550 may have a transfer hand that transfers the substrate W. The interface robot 550 may be provided as one or a plurality of robots. According to the exemplary embodiment, the interface robot 550 has a first robot 552 and a second robot 554. The first robot 552 may be provided to transfer the substrate W between the coating block 300*a*, the addition process chamber 520, and the interface buffer 530, the second robot 554 may transfer the substrate W between the interface buffer 530 and the exposure device 700, and a second robot 4604 may be provided to transfer the substrate W between the interface buffer 530 and the development block 300*b*.

The first robot 552 and the second robot 554 each include a transfer hand on which the substrate W is placed, and the hand may be provided to move forward and backward, rotate around an axis parallel to the third direction 16, and move in the third direction 16.

Hereinafter, the structure of the liquid processing chamber will be described in detail. Hereinafter, the liquid processing chamber provided in the coating block will be described as an example. Further, a case in which the liquid processing chamber is a chamber that applies a photoresist on the substrate W will be described as an example. However, the liquid processing chamber may be a chamber that forms a film such as a protective film or an anti-reflection film on the substrate W. Furthermore, the liquid processing chamber may be a chamber that develops the substrate W by supplying a developing solution to the substrate W.

Figure 7:
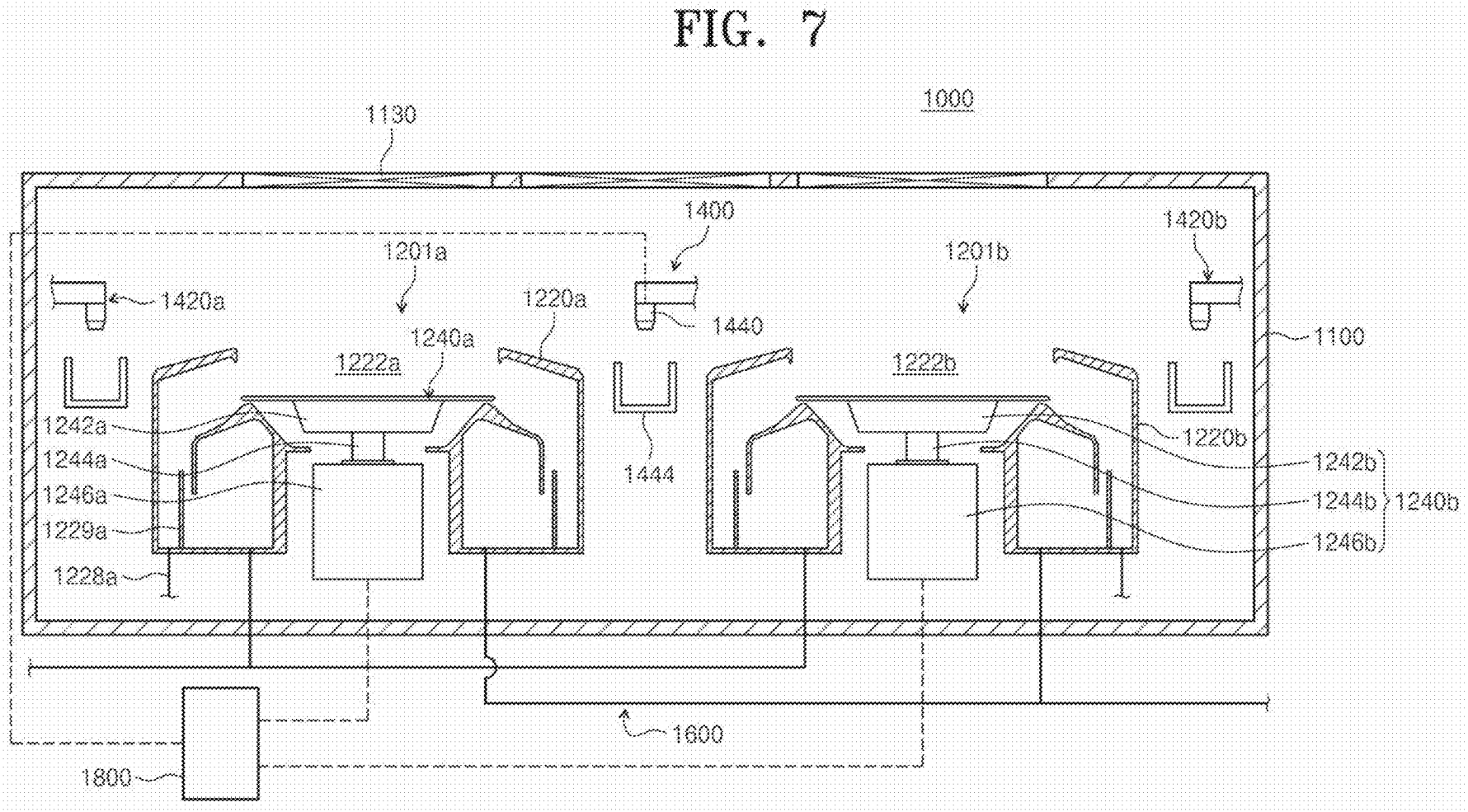
FIG. 7 is a cross-sectional view illustrating one embodiment of a liquid processing chamber in which a processing liquid is supplied to a rotating substrate W to process the substrate W with liquid.
Figure 8:
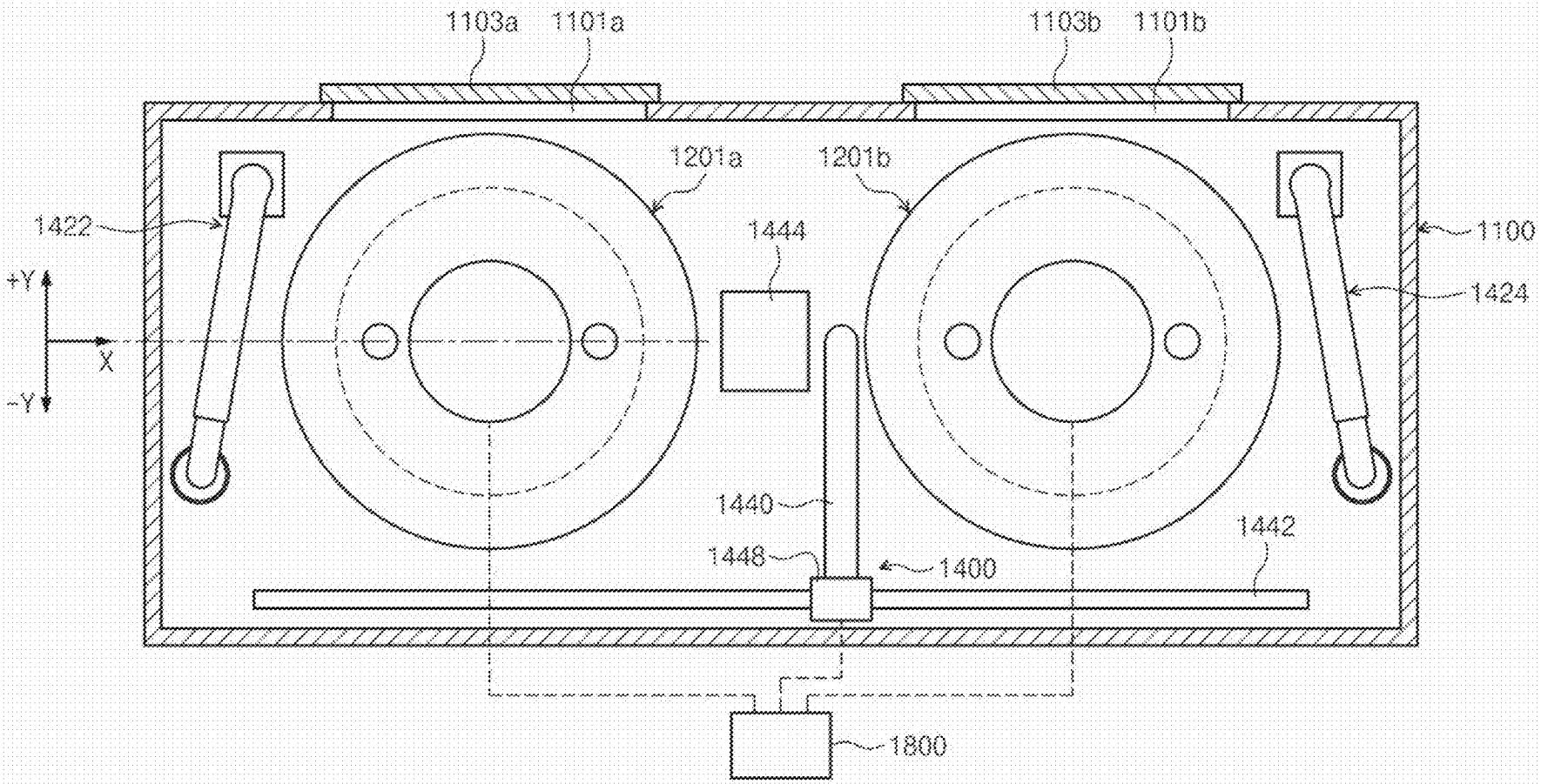
FIG. 8 is a top plan view of the liquid processing chamber of FIG. 7.

FIG. 7 is a cross-sectional view illustrating one embodiment of the liquid processing chamber in which a processing liquid is supplied to a rotating substrate W to process the substrate W with liquid, and FIG. 8 is a top plan view of the liquid processing chamber of FIG. 7.

Referring to FIGS. 7 and 8, the liquid processing chamber 1000 includes a housing 1100, a first treatment unit 1201*a*, a second treatment unit 1201*b*, a liquid supply unit 1400, an exhaust unit 1600, and a controller 1800.

The housing 1100 is provided in a rectangular cylindrical shape having an inner space. Openings 1101*a* and 1101*b* are formed at one side of the housing 1100. The openings 1101*a* and 1101*b* function as a passage through which the substrate W is carried in and out. The openings 1101*a* and 1101*b* are provided with doors 1103*a* and 1103*b*, and the doors 1103*a* and 1103*b* open and close the openings 1101*a* and 1101*b*.

A fan filter unit 1130 that supplies a downflow to an inner space thereof is disposed on an upper wall of the housing 1100. The fan filter unit 1130 has a fan through which external air is introduced into the inner space and a filter that filters the external air.

A first processing unit 1201*a* and a second processing unit 1201*b* are provided in the inner space of the housing 1100. The first processing unit 1201*a* and the second processing unit 1201*b* are arranged in one direction. Hereinafter, a direction in which the first processing unit 1201*a* and the second processing unit 1201*b* are arranged refers to a unit arrangement direction, and is illustrated in an X-axis direction in FIG. 11.

The first processing unit 1201*a* has a first processing container 1220*a* and a first support unit 1240*a*.

The first processing container 1220*a* has a first inner space 1222*a*. The first inner space 1222*a* is provided such that an upper part thereof is opened.

The first support unit 1240*a* supports the substrate W in the first inner space 1222*a* of the first processing container 1220*a*. The first support unit 1240*a* has a first support plate 1242*a*, a first drive shaft 1244*a*, and a first driver 1246*a*. An upper surface of the first support plate 1242*a* is provided in a circular shape. The first support plate 1242*a* has a diameter smaller than that of the substrate W. The first support plate 1242*a* is provided to support the substrate W by vacuum pressure. Alternatively, the first support plate 1242*a* may have a mechanical clamping structure that supports the substrate W. The first drive shaft 1244*a* is coupled to a central part of a bottom surface of the first support plate 1242*a*, and the first drive shaft 1244*a* is provided with the first driver 1246*a* that supplies a rotational force to the first drive shaft 1244*a*. The first driver 1246*a* may be a motor.

The second processing unit 1201*b* has a second processing container 1220*b* and a second support unit 1240*b*, and the second support unit 1240*b* has a second support plate 1242*b*, a second drive shaft 1244*b*, and a second driver 1246*b*. The second processing container 1220*b* and the second support unit 1240*b* have substantially the same structure as the first processing container 1220*a* and the first support unit 1240*a*.

The liquid supply unit 1400 supplies a liquid to the substrate W. The liquid supply unit 1400 includes a first nozzle 1420*a*, a second nozzle 1420*b*, and a processing liquid nozzle 1440. The first nozzle 1420*a* supplies a liquid to the substrate W provided in the first support unit 1240*a*, and the second nozzle 1420*b* supplies a liquid to the substrate W provided in the second support unit 1240*b*. The first nozzle 1420*a* and the second nozzle 1420*b* may be provided to supply the same kind of liquid. According to the exemplary embodiment, the first nozzle 1420*a* and the second nozzle 1420*b* may supply a rinse liquid for cleaning the substrate W. For example, the rinse liquid may be water. As another example, the first nozzle 1420*a* and the second nozzle 1420*b* may supply a removal liquid for removing a photoresist from the edge region of the substrate W. For example, the removal liquid may be a thinner. Each of the first nozzle 1420*a* and the second nozzle 1420*b* may be rotated between a process position and a waiting position with respect to a rotation axis thereof. The process position is a position where the liquid is discharged on the substrate W, and the waiting position is a position where the first nozzle 1420*a* and the second nozzle 1420*b* wait, respectively, without discharging the liquid on the substrate W.

The processing liquid nozzle 1440 supplies the processing liquid to the substrate W provided in the first support unit 1240*a* and the substrate W provided in the second support unit 1240*b*. The processing liquid may be a photoresist. A nozzle driver 1448 drives the processing liquid nozzle 1440 such that the processing liquid nozzle 1440 moves between a first process position, the waiting position, and a second process position along a guide 1442. The first process position is a position in which the processing liquid is supplied to the substrate W supported by the first support unit 1240*a*, and the second process position is a position in which the processing liquid is supplied to the substrate W supported by the second support unit 1240*b*. The waiting position is a position in which waiting is made in a waiting port 1444 disposed between the first processing unit 1201*a* and the second processing unit 1201*b* when the photoresist is not discharged from the processing liquid nozzle 1440.

A gas-liquid separation plate 1229*a* may be provided in an inner space 1201*a* of a first treatment container 1220*a*. The gas-liquid separation plate 1229*a* may be provided to extend upward from a bottom wall of the first treatment container 1220*a*. The gas-liquid separation plate 1229*a* may be provided in a ring shape.

According to the exemplary embodiment, the outside of the gas-liquid separator 1229*a* may be provided as a discharge space for discharging liquid, and the inside of the gas-liquid separator 1229*a* may be provided as an exhaust space for exhausting the atmosphere. A discharge pipe 1228*a* discharging the processing liquid is connected to the bottom wall of the first treatment container 1220*a*. The discharge pipe 1228*a* discharges the processing liquid introduced between a sidewall of the first treatment container 1220*a* and the gas-liquid separation plate 1229*a* to the outside of the first treatment container 1220*a*. An airflow flowing into a space between the sidewall of the first treatment container 1220*a* and the gas-liquid separation plate 1229*a* is introduced into the gas-liquid separation plate 1229*a*. In this process, the processing liquid contained in the airflow is discharged from the discharge space to the outside of the first treatment container 1220*a* through the discharge pipe 1228*a*, and the airflow is introduced into the exhaust space of the first treatment container 1220*a*.

Although not illustrated, an elevating driver that adjusts a relative height between the first support plate 1242*a* and the first processing container 1220*a* may be provided.

Figure 9:
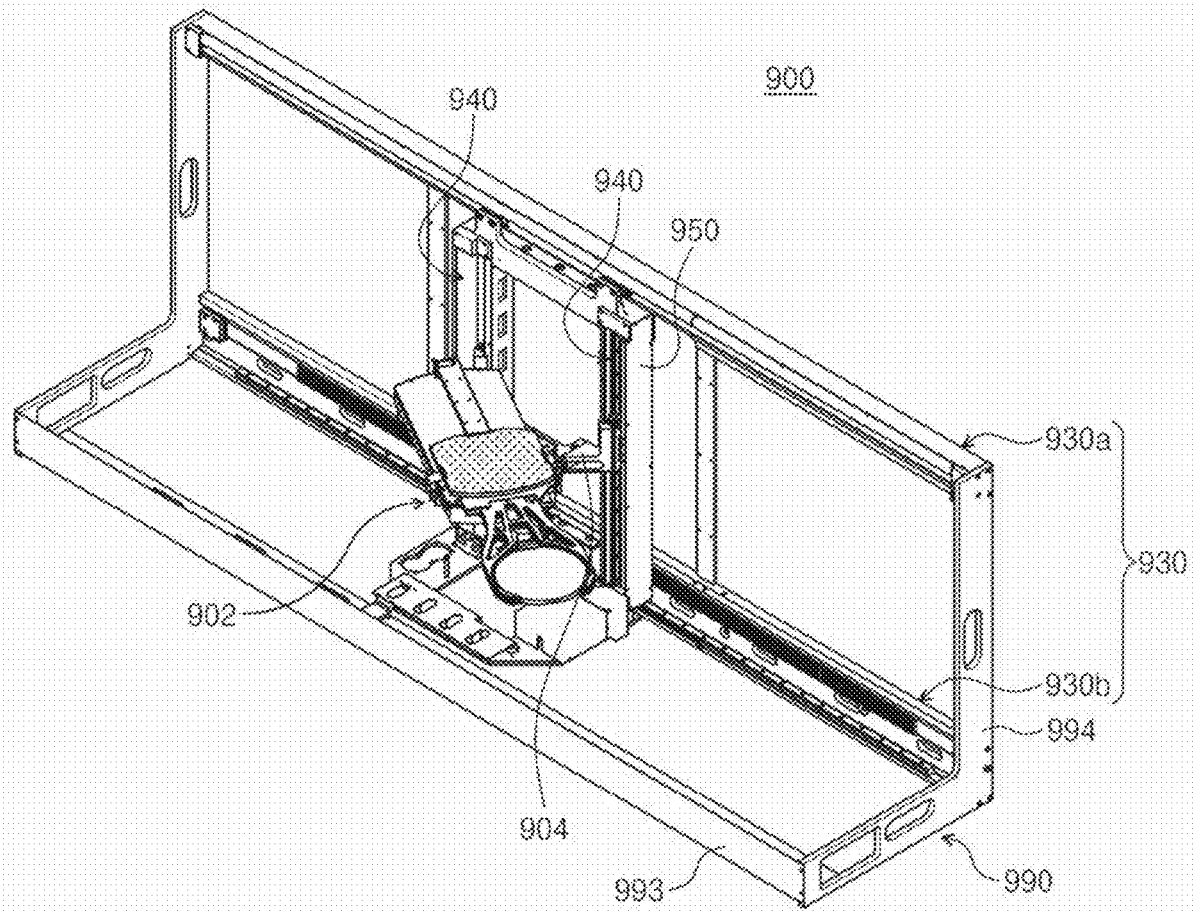
FIG. 9 is a perspective view illustrating an example of the transfer robot of FIG. 3.

FIG. 9 is a perspective view illustrating an example of the transfer robot of FIG. 3.

Hereinafter, the robot 900 of FIG. 9 will be described as a transfer robot of FIG. 3. However, in contrast, the transfer robot may be an index robot, and may optionally be another robot provided in the substrate processing apparatus 1.

Referring to FIG. 9, the transfer robot 900 may include a robot body 902, a horizontal driver 930, and a vertical driver 940.

The robot body 902 may include a hand 910 capable of advancing and retreating (X direction) and rotating (θ-direction) by supporting the substrate, and a hand driver 920 including a base supporting the hand 910.

The hand driver 920 horizontally moves the hand 910, and the hand 910 is individually driven by the hand driver 920. The hand driver 920 includes a connection arm 912 connected to an internal driving unit (not illustrated), and the hand 910 is installed in an end of the connection arm 912. In the present embodiment, the transfer robot 900 includes two hands 910, but the number of hands 910 may increase according to the process efficiency of a substrate processing apparatus 10. A rotation unit (not illustrated) is installed below the hand driver 920. The rotation unit is coupled to the hand driver 920 and rotates to rotate the hand driver 920. Accordingly, the hands 910 rotate along.

The horizontal driver 930 and the vertical driver 940 are mounted in one body frame 990.

The body frame 990 may be provided in a form in which several frames are coupled to each other. The body frame (990) may include an upper horizontal driver 930*a* and a lower horizontal driver 930*b* guiding a robot body in an Y direction, a vertical auxiliary frame 992 vertically erected between the upper and lower horizontal drives 930*a* and 930*b*, a horizontal auxiliary frame 993 extending parallel to the lower horizontal driver 930*b* to form a shape of the body frame 990, and a coupling auxiliary frame 994 that creates a lateral shape of the body frame 990 by coupling the upper and lower horizontal drives 930*a* and 930*b* to ends of the horizontal auxiliary frame 993.

As such, since the body frame 990 is configured by combining a number of auxiliary frames 992, 993 and 994, its rigidity is enhanced, and durability capable of maintain the shape completely even when used for a long time is enhanced.

The horizontal drivers 930*a* and 930*b* are driving guides for moving the robot body 902 in the Y direction as described above, and are coupled to opposite front ends of the vertical driver 940. Among the horizontal drivers 930*a* and 930*b*, a horizontal direction driver (not illustrated) including a transfer belt is embedded, specifically, in an inner surface of the lower horizontal driver 930*b*. Accordingly, the robot body 902 is horizontally moved along the horizontal drivers 930*a* and 930*b* by driving the transfer belt.

The vertical driver 940 is a kind of driving unit for moving the robot body 902 in a Z direction, and is coupled to the upper and lower horizontal drivers 930*b* and 930*a*. Accordingly, the robot body 902 may be guided by the horizontal drivers 930*b* and 930*a* and moved in the Y direction, and may also be guided by the vertical driver 940 and moved in in the Z direction. That is, the robot body 902 may be moved in an oblique direction corresponding to the sum of the Y direction and the Z direction.

Meanwhile, since the vertical driver 940 is composed of a plurality of vertical frames spaced apart from each other, for example, two vertical frames, the robot body 902 can freely enter and exit a space between the two frames.

A vertical direction driver (hereinafter referred to as a vertical driver) including a transfer belt is embedded in a vertical frame 950 of the vertical driver 940.

Figure 10:
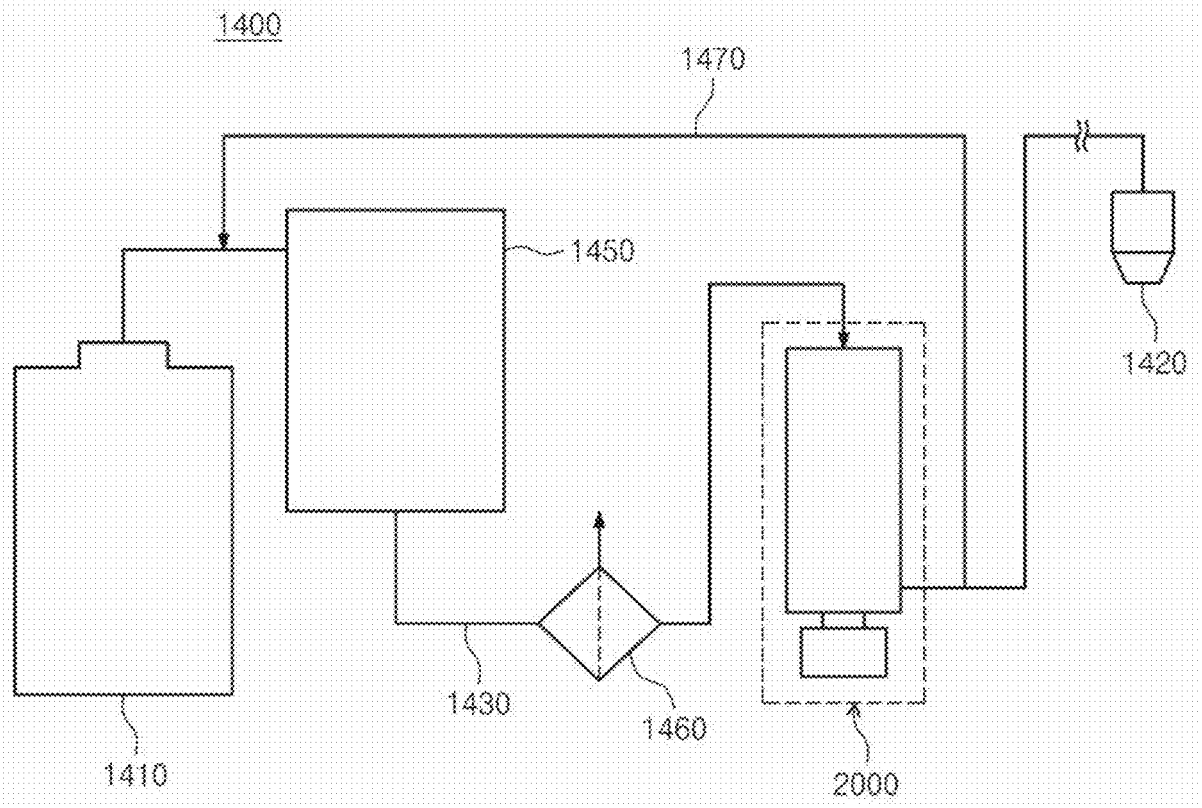
FIG. 10 is a structural view illustrating a liquid supply unit.

FIG. 10 is a structural view illustrating a liquid supply unit.

Referring to FIG. 10, the liquid supply unit 1400 may include a nozzle 1420, a liquid accommodating member 1410, a liquid supply line 1430, a trap tank 1450, a pump 2000, a filter 1460, and a purge line 1470. Here, the nozzle may include a first nozzle 1420*a*, a second nozzle 1420*b*, and a processing liquid nozzle 1440 illustrated in FIG. 7.

The liquid supply line 1430 connects the nozzle 1420 to the liquid accommodating member 1410. A trap tank 1450, a pump 2000, and a filter 1460 are installed between the nozzle 1420 and the liquid accommodating member 1410. The liquid accommodating member 1410 has an accommodation space in which the processing liquid is accommodated. The liquid accommodating member 1410 may be a bottle in which the processing liquid is accommodated. The processing liquid may be a photosensitive liquid containing fluorine (F).

Bubbles of the processing liquid flowing through the liquid supply line 1430 may be removed from the trap tank 1450. The trap tank 1450 is disposed between the nozzle 1420 and the liquid accommodating member 1410 in the liquid supply line 1430.

The pump 2000 presses the liquid supply line 1430 such that the processing liquid flowing through the liquid supply line 1430 is supplied towards the nozzle 1420. The pump 2000 is disposed downstream of the trap tank 1450 in the liquid supply line 1430. According to the exemplary embodiment, the pump 2000 may discharge the processing liquid in a way of discharging the processing liquid in a tube by giving torsion to the tube to induce a change in the volume of the tube.

A filter 1500 filters impurities of the processing liquid flowing through the liquid supply line 1200. The filter 1500 is disposed between the trap tank 1300 and the pump 2000 in the liquid supply line 1200. The filter 1500 may be disposed closer to the pump 2000 than the trap tank 1300 in the liquid supply line 1200. Impurities are filtered from the processing liquid while the processing liquid passes through the filter 1500.

The purge line 1470 is connected to the liquid supply line 1200 such that the processing liquid passing through the pump 2000 is returned to the trap tank 1300.

Figure 11:
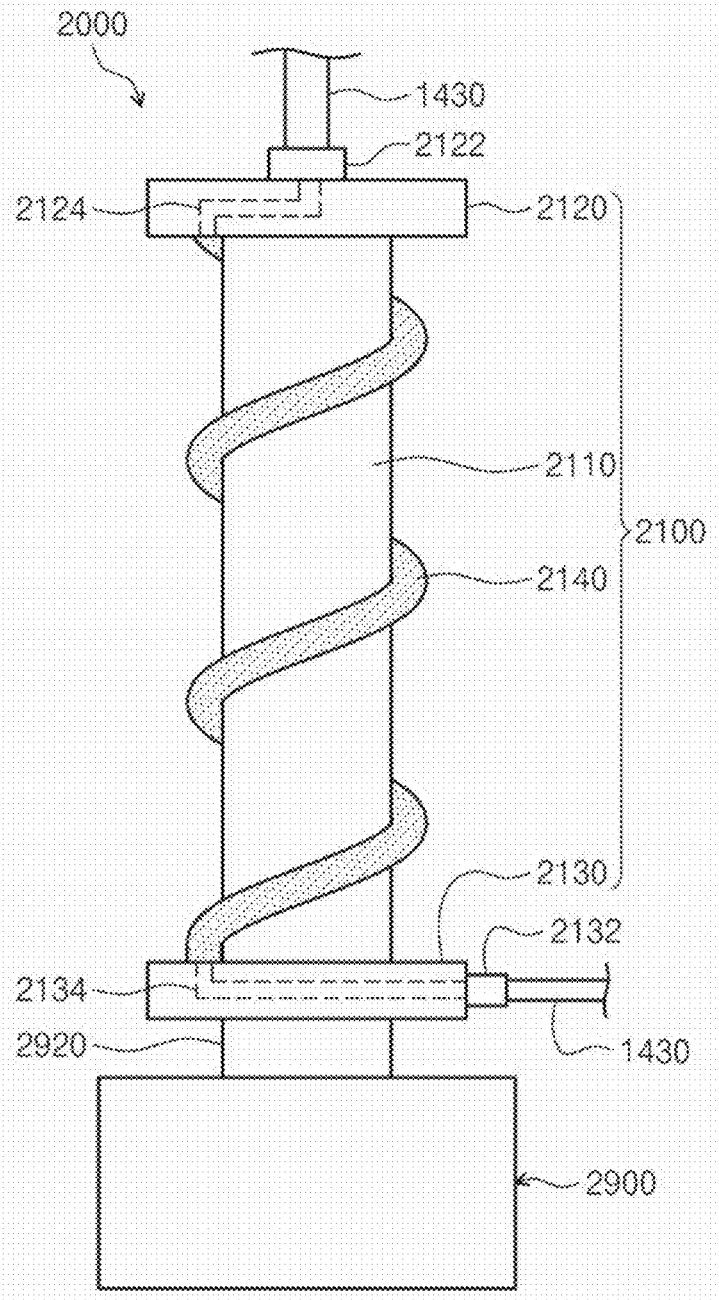
FIG. 11 is a view illustrating the pump illustrated in FIG. 10.
Figure 12:
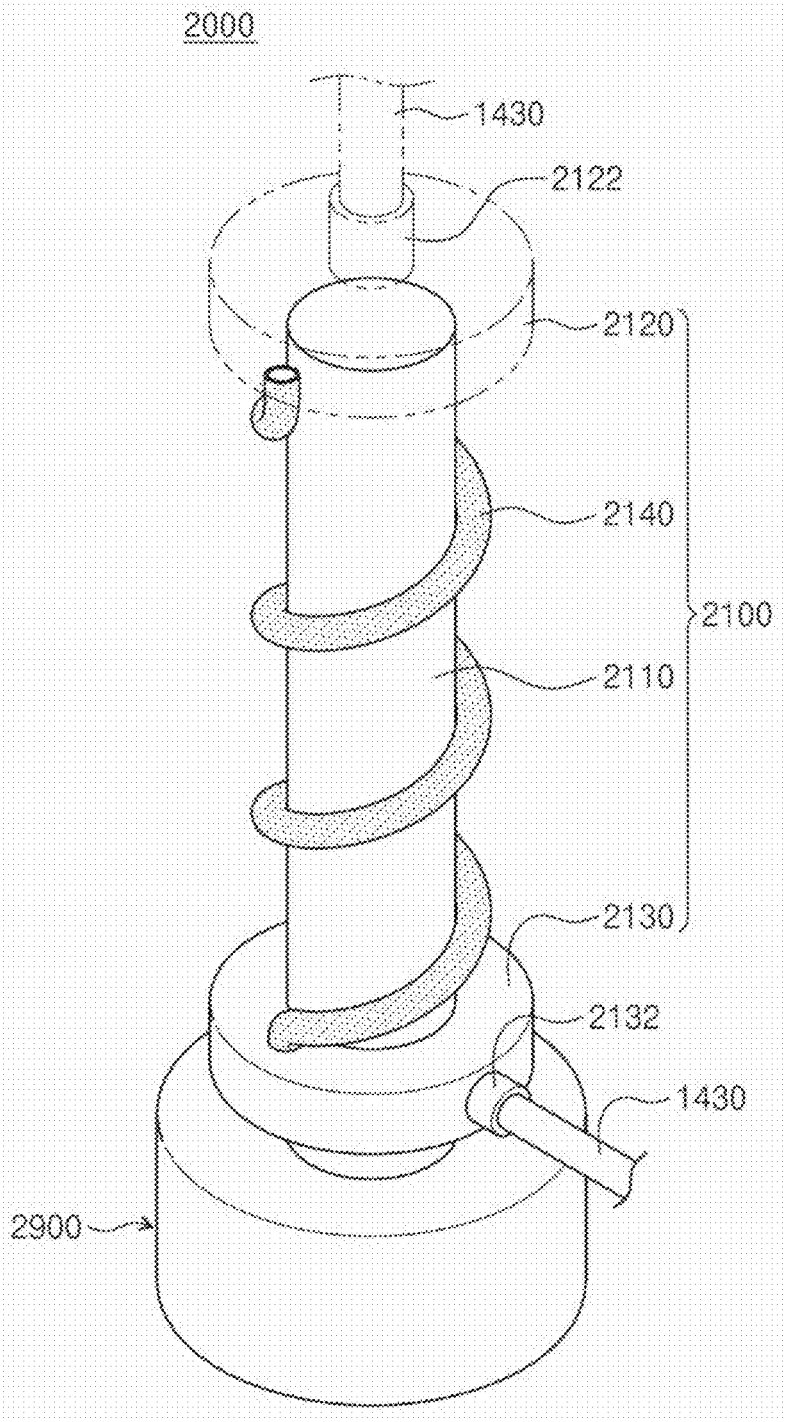
FIG. 12 is a perspective view illustrating a pump illustrated in FIG. 11.
Figure 13:
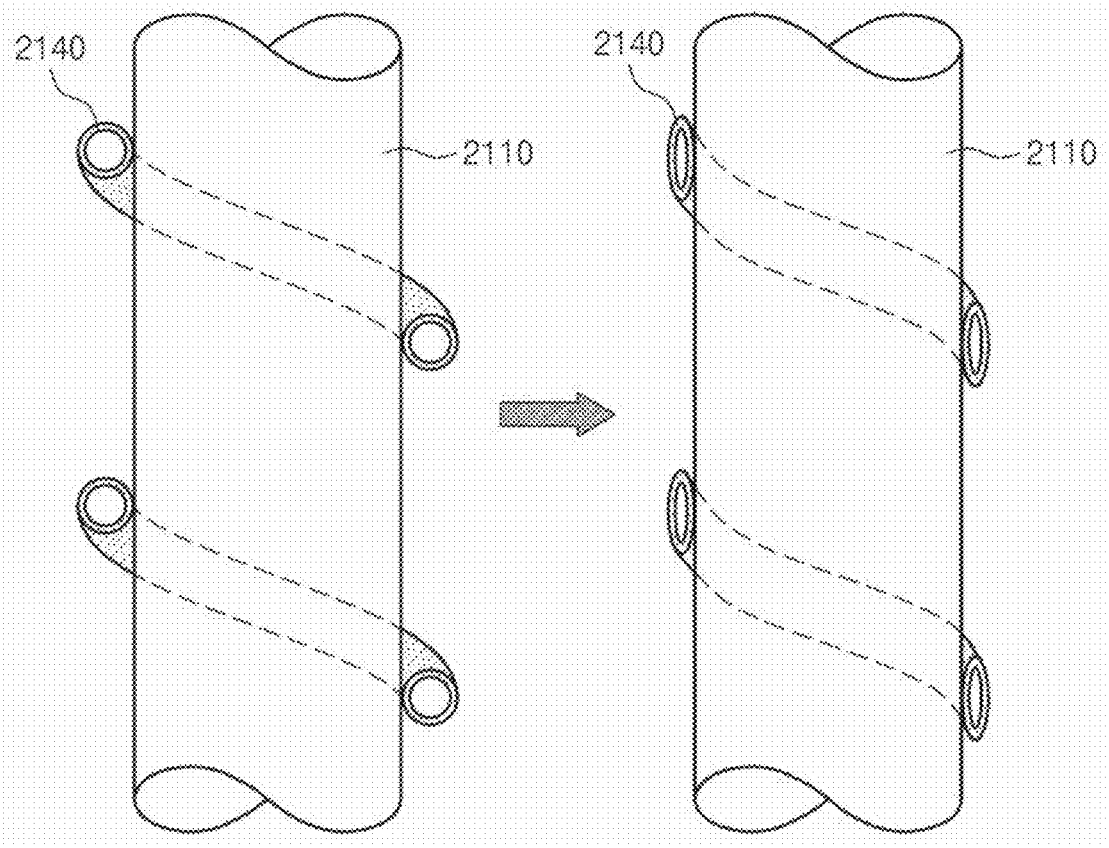
FIG. 13 is a diagram illustrating a volume change of a hose due to a winding operation.

FIG. 11 is a view illustrating the pump illustrated in FIG. 10, FIG. 12 is a perspective view illustrating a pump illustrated in FIG. 11, and FIG. 13 is a diagram illustrating a volume change of a hose due to a winding operation.

Referring to FIGS. 11 to 13, the pump 2000 may include a tube member 2100 and a driver 2900. The pump 2000 uses a way of discharging the processing liquid of the tube member 2100 by giving a torsion to the tube member 2100 to induce a change in the volume of the tube member 2100.

For example, the tube member 2100 may include a flexible hose 2140, a cylindrical drum 2110 provided to wind the hose 2140 thereon, a first flange 2120 provided in one end of the drum 2110, and a second flange 2130 provided in the other end of the drum 2110.

The hose 2140 is wound around the drum 2110 by the rotational force applied from the outside, and the volume thereof is changed. The hose 2140 may be made of a flexible polymer material. Any material of the hose 2140 may be used as long as it can be pressed flat while being wound around the drum 2110 when an external force is applied to the hose 2140. The hose 2140 is preferably produced to have an elastic restoring force such that the hose 2140 can be restored to an initial state when the force applied from the outside is released. The hose 2140 may be manufactured not to have the elastic restoring force. This is because the hose 2140 can be restored to an initial state by using an externally applied force for a torsional operation of the hose 2140. However, if the hose 2140 is produced to have an elastic restoration force and can be restored to an initial state by itself, a load of the externally applied force can be reduced. Accordingly, the hose 2140 is preferably produced to have the elastic restoration force.

Opposite ends of the hose 2140 are opened such that the processing liquid to can enter and exit the hose. One end of the hose is connected to the first flange 2120, and the other end of the hose 2140 is connected to the second flange 2130.

The first flange 2120 may have an inlet 2122 formed for introducing the processing liquid into a hose. The first flange 2120 may be provided with a first flow path 2124 connecting the inlet 2122 and an upper end of the hose 2140.

The second flange 2130 may have an outlet 2132 for discharging the processing liquid from a hose. The second flange 2130 may be provided with a second flow path 2134 connecting the outlet 2132 and a lower end of the hose 2140.

The first flange 2120 may be fixed to a separate structure such that rotation is not allowed. The second flange 2130 may be connected to the driver 2900 to receive the rotational force and be rotated. Although not illustrated, the second flange 2130 may be composed of an inner flange rotated by a rotation shaft 2920 and an outer flange with the outlet 2132. The outer flange may be provided with a bearing between the inner flange and the outer flange such that the outer flange cannot be rotated even when the inner flange is rotated, and the second flow path may be provided to the inner flange and the outer flange. Due to this structure, it is possible to prevent the liquid supply line 1430 connected to the discharge port 2132 from being twisted when the second flange 2130 is rotated.

The hose 2140 may be provided in a state in which the hose 2140 is wound around the drum 2110 in a coil shape, but the present invention is not limited thereto. However, if the hose 2140 is provided loosely wound around the drum 2110 from the beginning, a rapid volume change can be made when the hose 2140 is wound by the driver 2900, and a stable winding operation may be performed. Here, the number of windings of the hose may be changed.

The driver 2900 may provide the rotational force such that the hose 2140 is wound around the drum 2110. The driver 2900 may include a motor. The driver 2900 may include a decelerator for speed adjustment. The driver 2900 is connected to the second flange 2130. The rotational force of the driver 2900 is provided to the second flange 2130. When the second flange is rotated, the lower end of the hose is rotated along. In this case, the drum is not rotated. For the winding operation of the hose 2140, the driver 2900 may transmit the rotational force to the second flange and may be simultaneously deformed corresponding to a change in the length of the hose. For example, the rotation shaft 2920 of the driver 2900 may be provided in a ball screw manner. The second flange 2130 may be connected to the rotation shaft 2920 with a ball screw structure to enable rotation and a vertical movement.

According to the present invention, since a motor force of the driver 2900 is transmitted as a force directly winding the hose 2140 around the drum 2110, there is no need for an additional device to change the direction of the force, thereby reducing the size of the pump.

The operation of the pump having the above-described structure is as follows.

In a state in which the inlet 2122 is opened and the outlet 2132 is closed, which is a suction operation of the pump 2100, when the hose 2140 is restored to the initial state, the processing liquid is introduced into the hose 2140 through the inlet 212. In a state in which the inlet 2122 is closed and the outlet 2132 is opened, which is a discharge operation of the pump 2100, when the 2140 is rotated, the hose 2140 is pressed flat and the processing liquid filled in the hose is discharged through the outlet 2132.

Since the pump 2000 with the aforementioned structure is made by twisting the hose 2140, it is possible to discharge a large amount of chemical liquids with a low rotational torque in a small space and a small amount of rotation.

Figure 14:
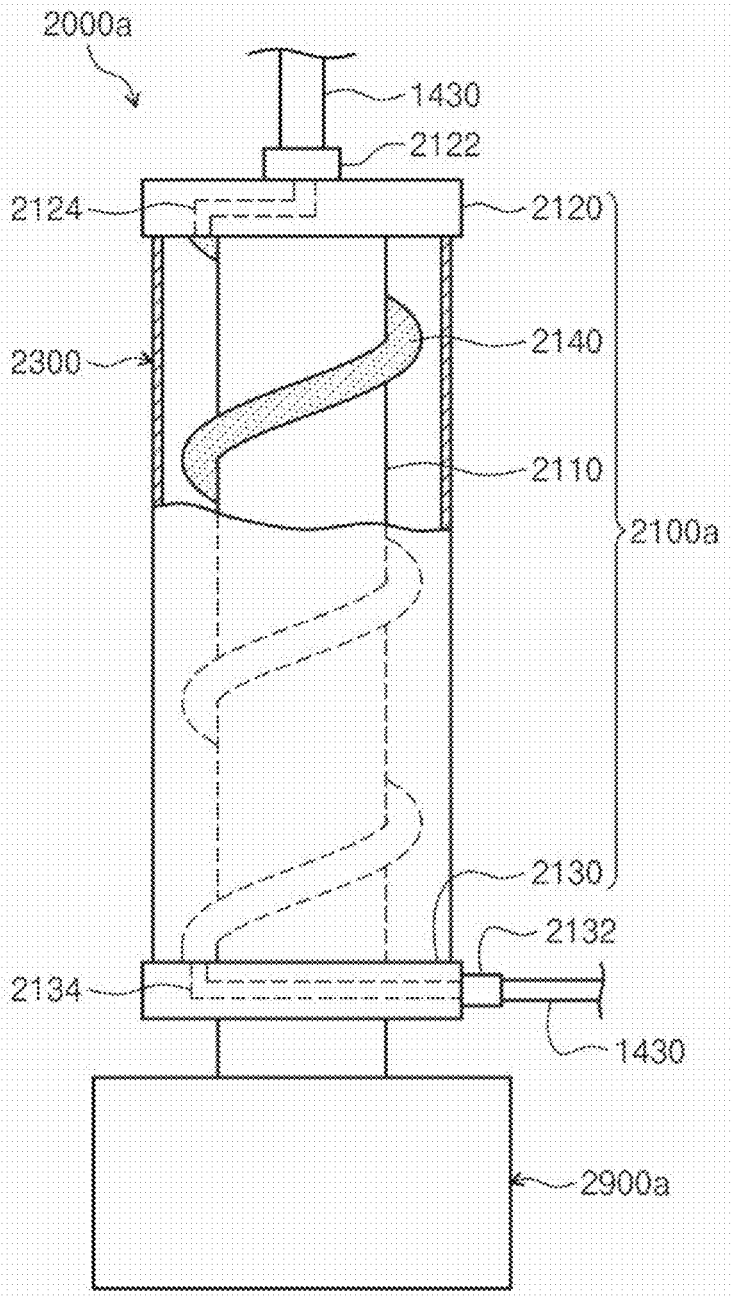
FIG. 14 is a front view illustrating a second embodiment of the pump.
Figure 15:
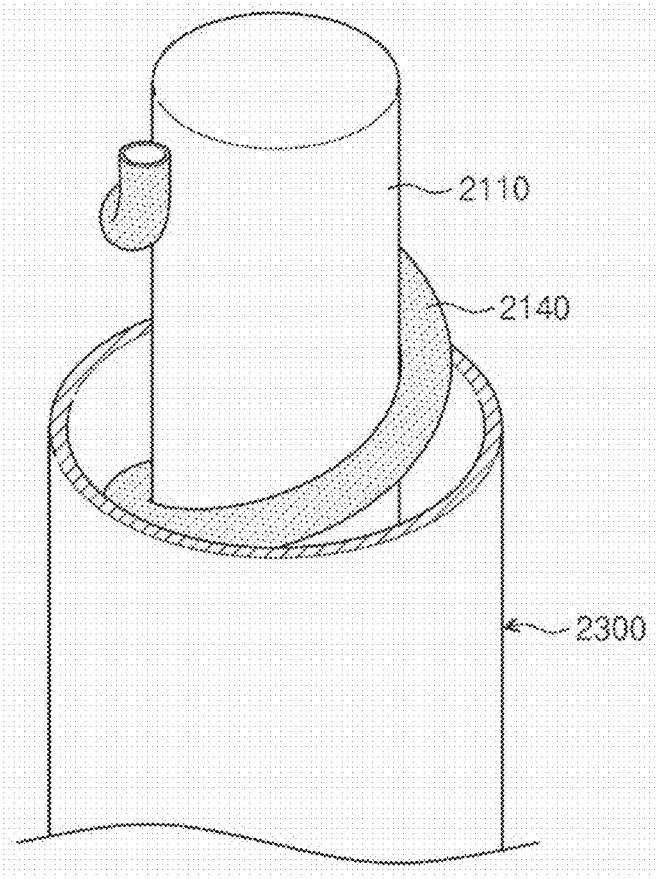
FIG. 15 is a cross-sectional perspective view of a tube member.

FIG. 14 is a front view illustrating a second embodiment of the pump, and FIG. 15 is a cross-sectional perspective view of the tube member.

As illustrated in FIGS. 14 and 15, a pump **2000*a* includes a tube member 2100*a* and a driver 2900*a*, and the tube member 2100*a* and the driver 2900*a* are provided in a configuration and function substantially similar to those of the tube 2100 and the driver 2900 of the pump 2000 illustrated in FIG. 11**. Hereinafter, the second embodiment will be described based on differences from the present embodiment.

In the exemplary of the present invention, the tube member **2100*a* is characterized by having a sealing case 2300. The sealing case 2300 may be provided between the first flange 2120 and the second flange 2130 such that the hose 2140 and the drum 2110 are isolated from an external environment. The sealing case 2300 may prevent the chemical liquid from leaking outside the pump when the chemical liquid is discharged from the hose 2140. For example, the sealing case 2300 may be provided in a cylindrical shape. The sealing case 2300 may be filled with an incompressible fluid inside. The incompressible fluid may be an inert gas (e.g., nitrogen gas) or liquid. The incompressible fluid filled in the sealing case 2300 blocks moisture penetration. One end of the sealing case 2300 may be fixed to the first flange 2120, and the other end of the sealing case 2300 may be connected to the second flange 2130**, and a bearing (not illustrated) may be provided therebetween. (The sealing case being prevented from rotating when the second flange is rotated)

Figure 16A:
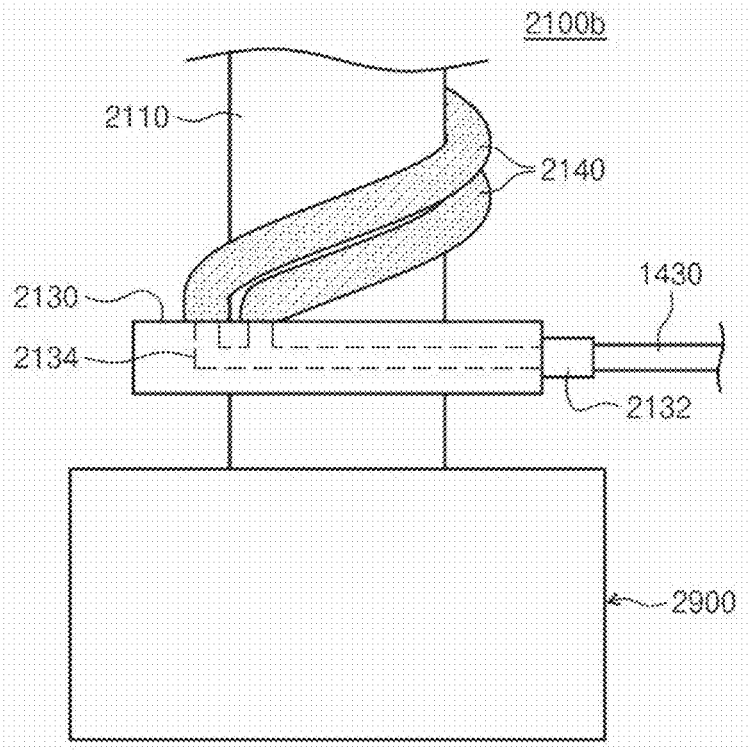
FIGS. 16A and 16B are views illustrating a first modified example of the tube member illustrated in FIG. 11.
Figure 16B:
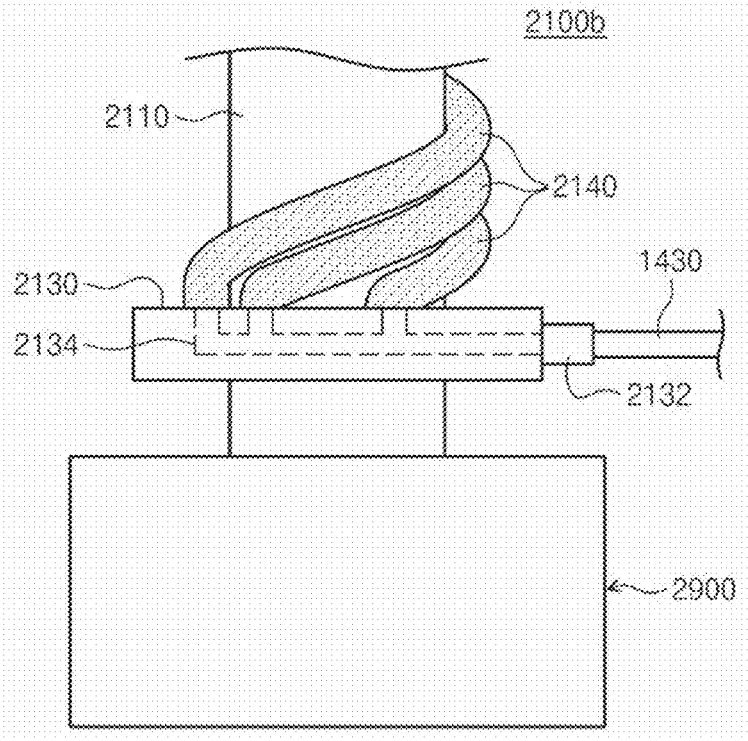

FIGS. 16A and 16B are views illustrating a first modified example of the tube member illustrated in FIG. 11.

In FIGS. 16A and 16B, a tube member 21*b* may include two or 3 hoses 2140, and the hoses 2140 are wound around the drum 2110 in the same direction so as not to overlap each other.

Figure 17:
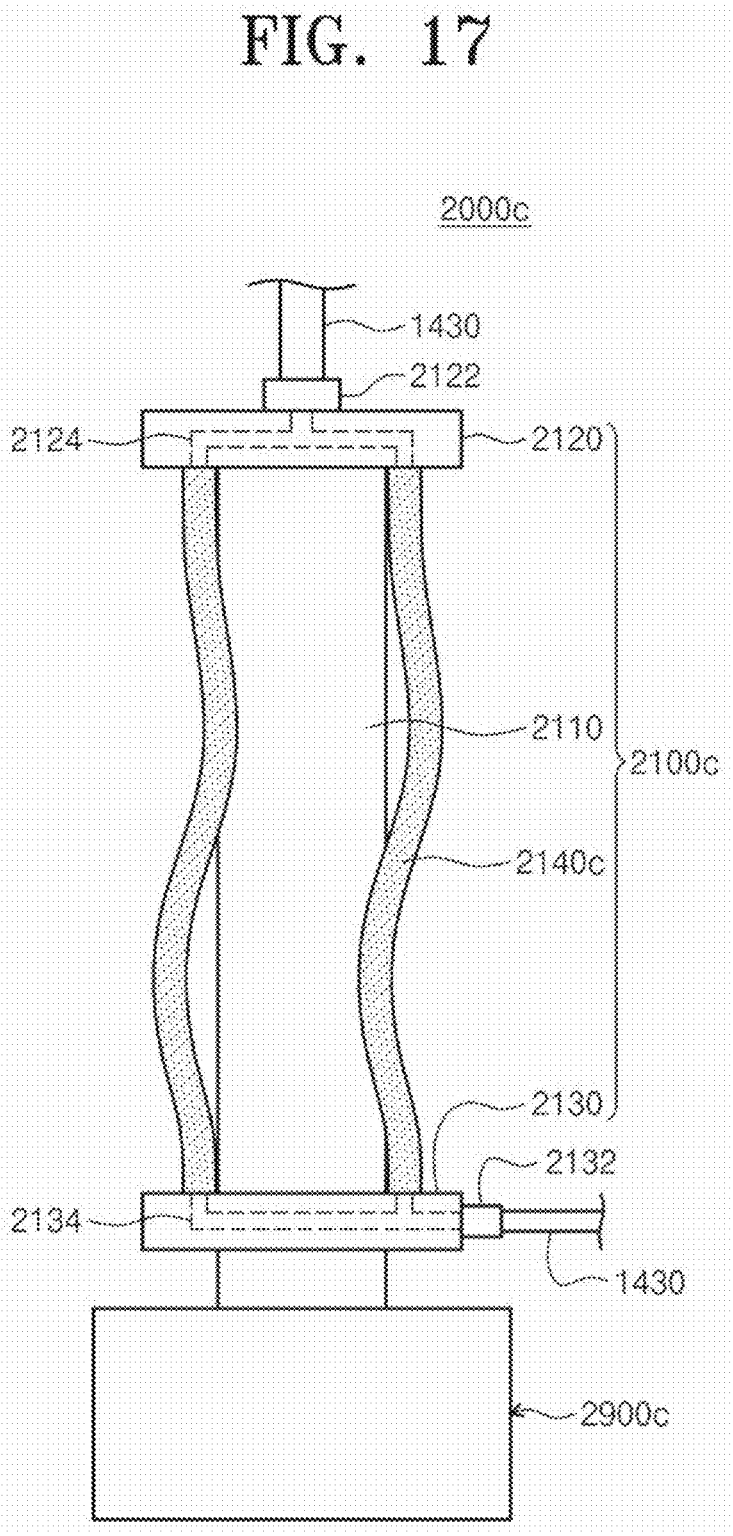
FIGS. 17 and 18 are views illustrating a second modified example of the pump.
Figure 18:
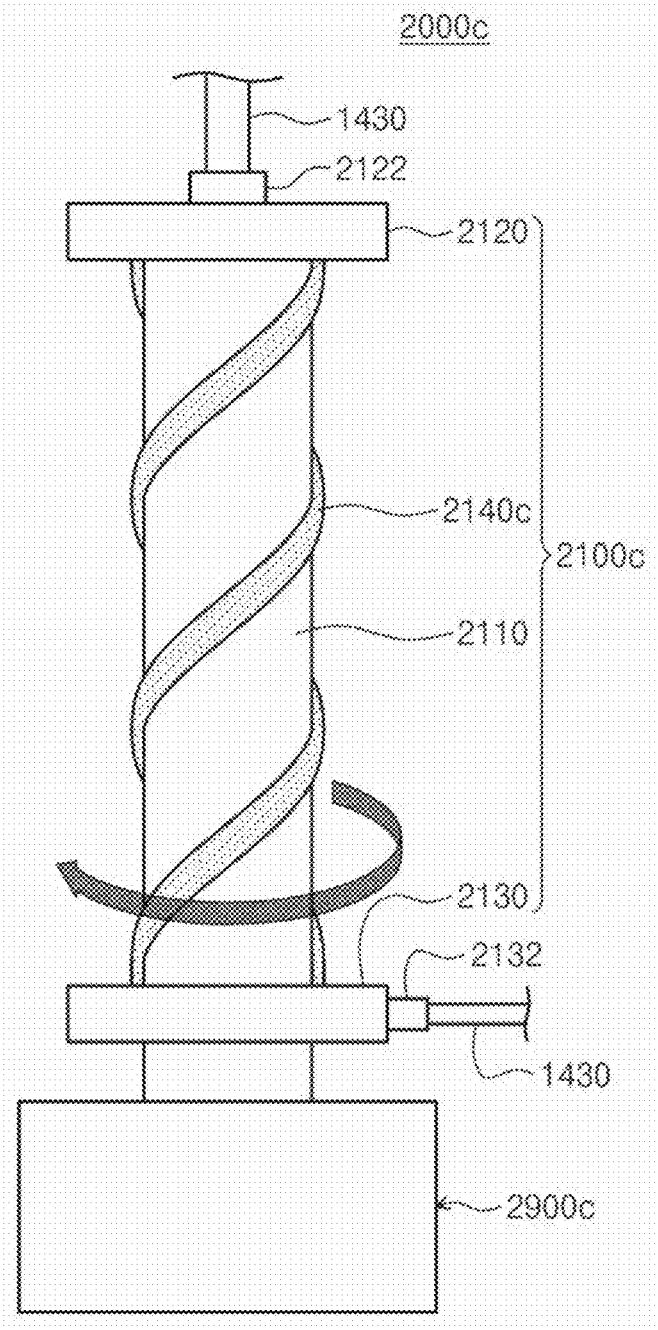

FIGS. 17 and 18 are views illustrating a second modified example of the pump.

Referring to FIG. 17 and FIG. 18, the pump 2000*c* includes a tube member 2100*c* and a driver 2900*c*, and the tube member 2100*c* and the driver 2900*c* are provided in a configuration and function similar to those of the tube member 2100 and the driver 2900 of the pump 2000 illustrated in FIG. 11. Hereinafter, the second modified example will be described based on differences from the present embodiment.

In this modified example, a hose 21140*c* may be provided in an unwound state rather than a pre-wound state on the drum 2110. During the discharge operation of the chemical liquid of the pump, the hose is wound around the drum by the driver, and during the suction operation of the chemical liquid of the pump, the hose is unwounded as illustrated in FIG. 17.

Figure 19:
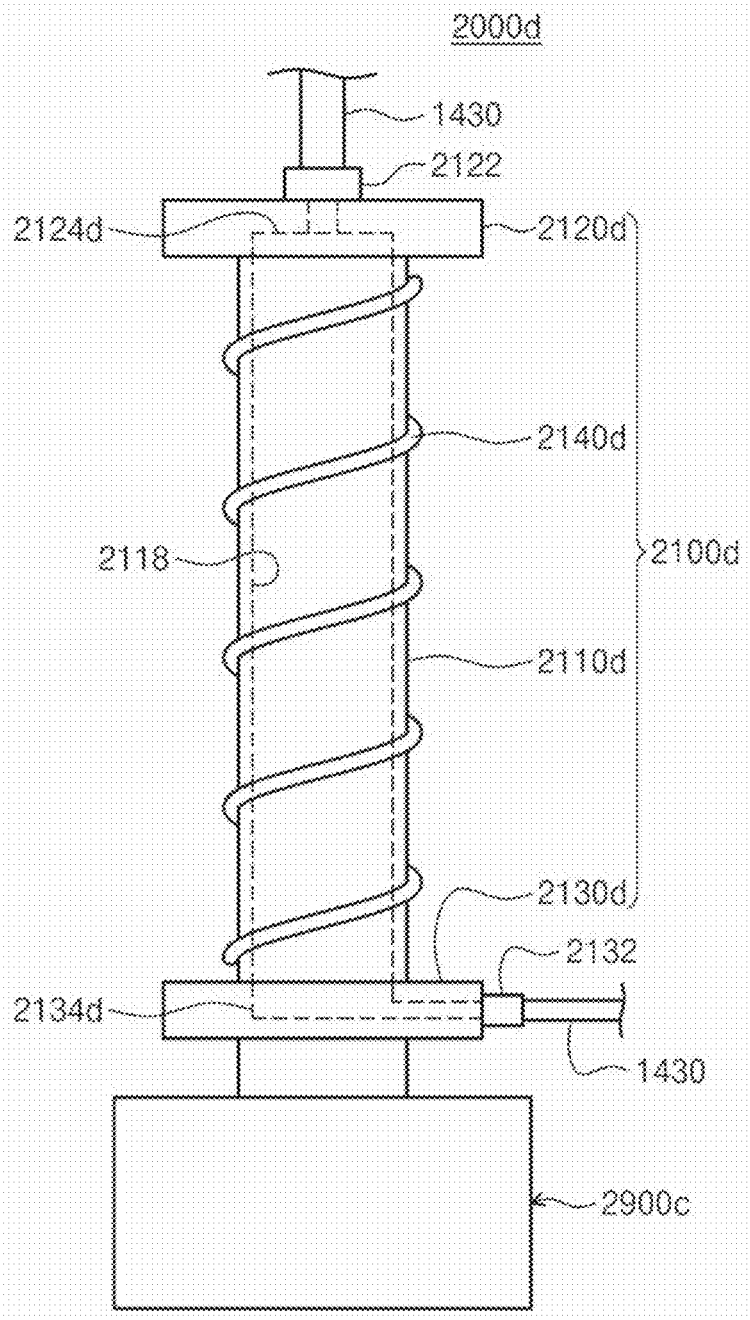
FIGS. 19 and 20 are views illustrating a third embodiment of the pump.
Figure 20:
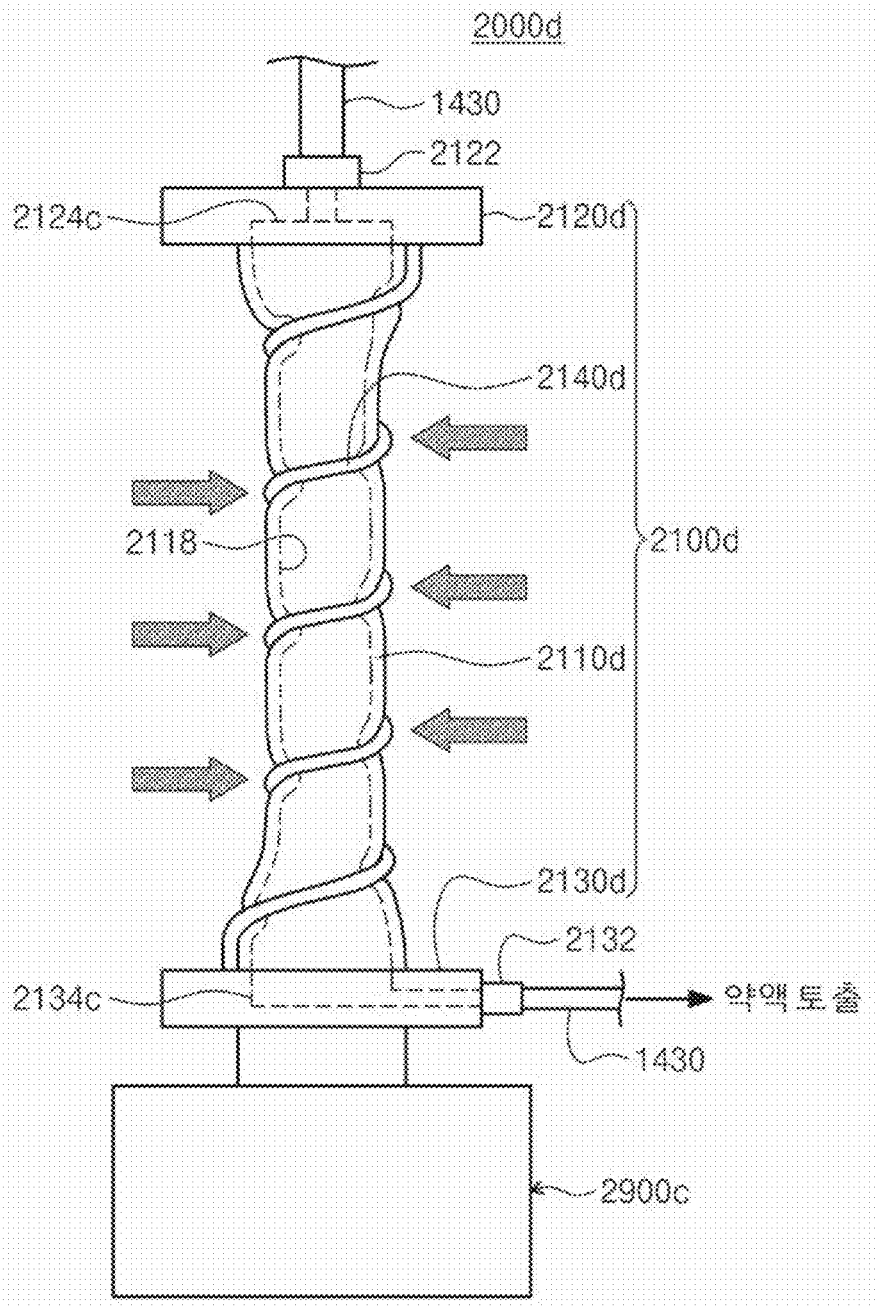

FIGS. 19 and 20 are views illustrating a third embodiment of the pump.

Referring to FIGS. 19 and 20, a pump 2000*d* includes a tube member 2100*d* and a driver 2900*d*, and the tube member 2100*d* and the driver 2900*d* are provided in a configuration and function substantially similar to those of the tube member 2100 and the driver 2900 of the pump 2000 illustrated in FIG. 11. Hereinafter, the third embodiment will be described based on differences from the present embodiment.

According to the third embodiment, the drum 2110*d* of the tube member 2100*d* may be made of a flexible material. The drum 2110*d* may provide an inner space (known as a pump chamber 2118) connecting the chemical liquid inlet 2122 and the chemical liquid outlet 2132. The drum 2110*d* is twisted by the rotation of the second flange 2130*d*, and the chemical liquid may be discharged through a volume change due to the twisting of the drum 2110*d*. A hose 2140*d* is not used to supply the chemical liquid, but is used to press the drum 2110*d*. However, the hose 2140*d* may also be used to supply the chemical liquid, like the hose 2140 illustrated in FIG. 11. If the hose 2140*d* is used for supplying the chemical liquid, both ends of the hose 2140*d* may be connected to a first flow path 2124*d* of a first flange 2120*d* and a second flow path 2134*d* of a second flange 2130.

Figure 21:
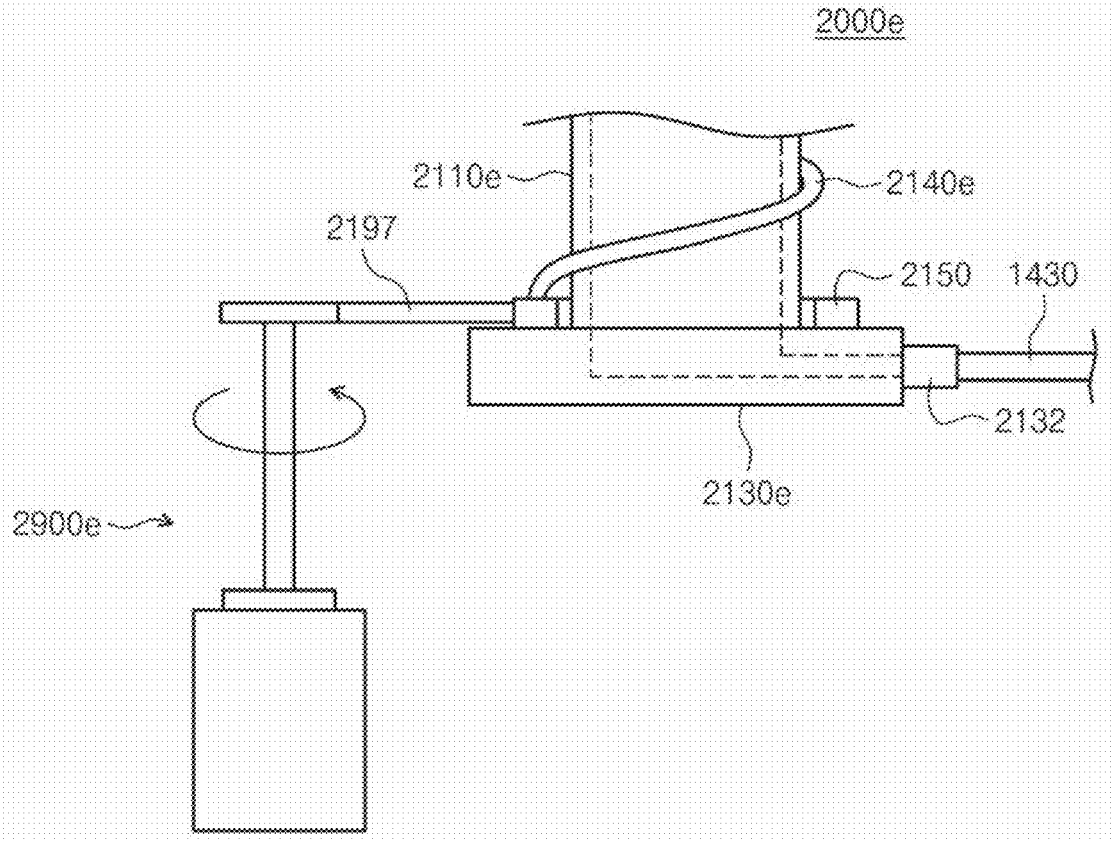
FIG. 21 is a diagram illustrating a modified example of the pump illustrated in FIG. 19.

FIG. 21 is a diagram illustrating a modified example of the pump illustrated in FIG. 19.

Referring to FIG. 21, a lower end of a hose 2140*e* may be fixed to a separate rotation ring 2150. The rotation ring 2150 may be installed on an upper surface of a second flange 2130*e* and can be rotated around an axis of a drum 2110*e*. The rotation ring 2150 may be rotated by a driver 2900*e*. The driver 2190*e* may rotate the rotation ring 2150 through a power transmission means 2197 such as a gear. In this case, the second flange 2130*e* and the drum 2110*e* are is rotated. In the present modified example, only the hose 2140*e* may be rotated independently to surround and press the drum 2110*e*.

Figure 22:
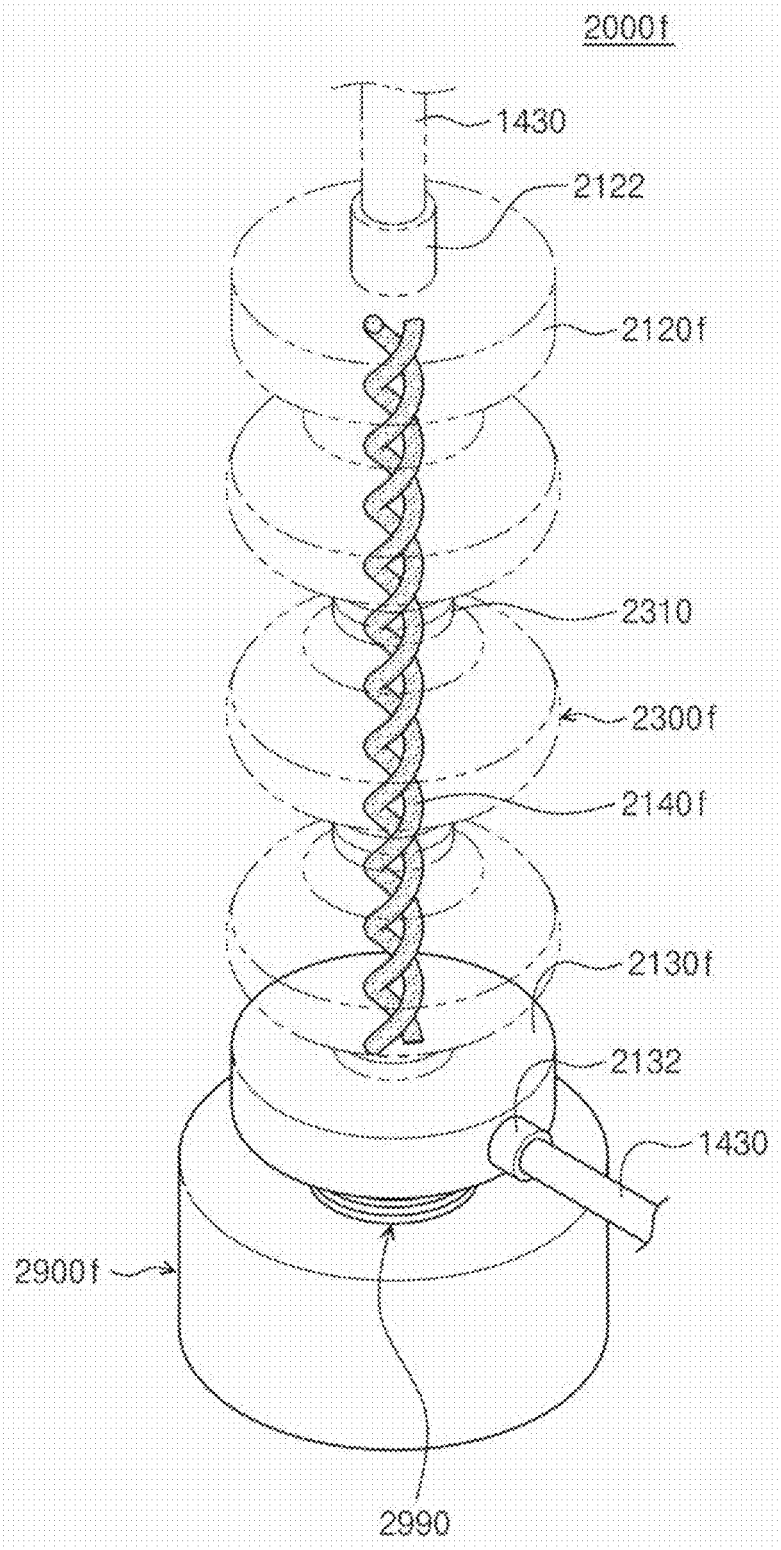
FIG. 22 is a view illustrating a fourth embodiment of the pump.

FIG. 22 is a view illustrating a fourth embodiment of the pump.

Referring to FIG. 22, a sealing case 2300*f* of a pump 2000*f* may be provided in a bellows form. In this case, the sealing case 2300*f* may be provided to rotate a bellows joint 2310 (i.e., a middle part). When a hose 2140*f* is twisted by a driver 2900*f*, an overall length of the hose is changed. In order to compensate for such a change, the driver 2900*f* may include a compensation member 2990. The compensation member 2990 may be provided in a ball screw manner A second flange 2130*f* may rotate and move up and down on the ball screw.

Figure 23:
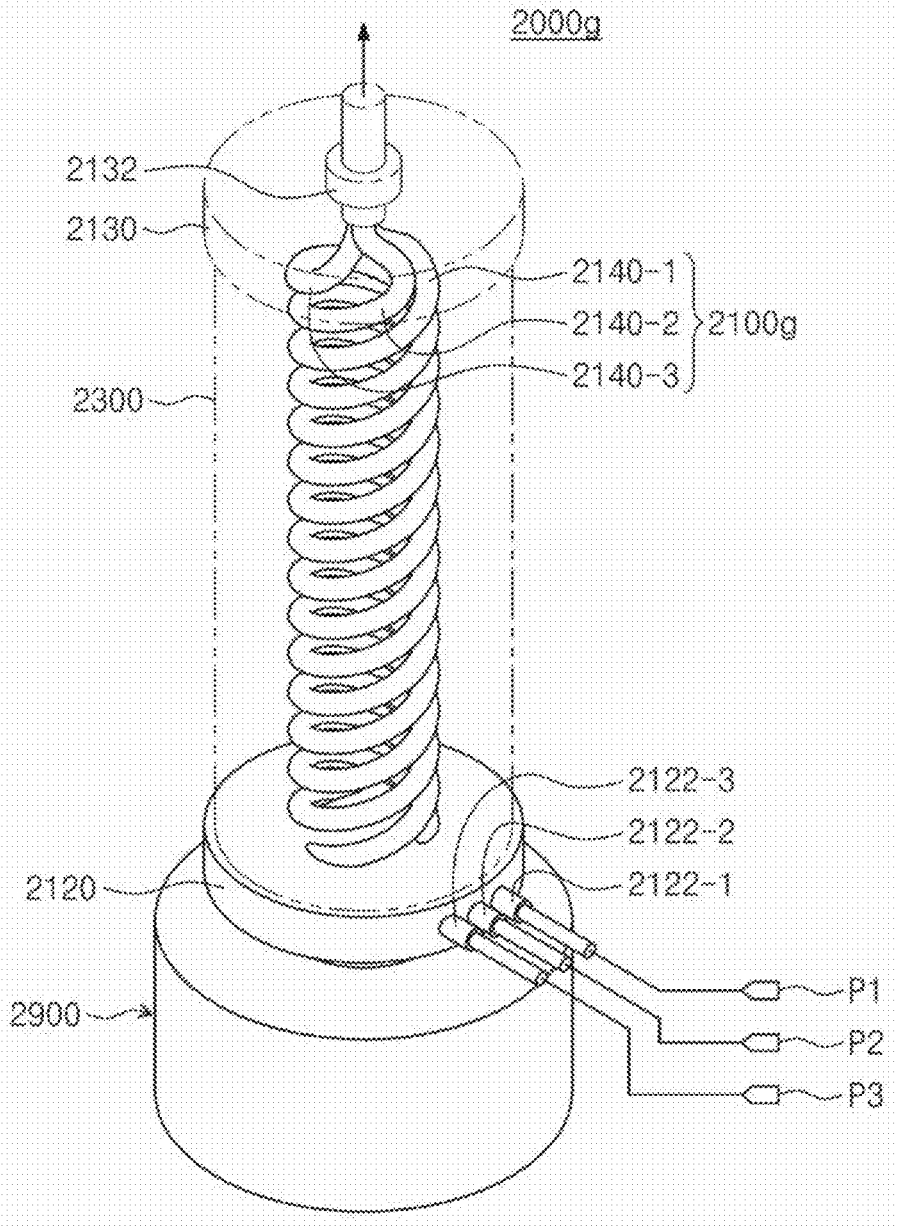
FIG. 23 is a view illustrating a fifth embodiment of the pump.

FIG. 23 is a view illustrating a fifth embodiment of the pump.

Referring to FIG. 23, a tube member 2100*g* of a pump 2000*g* may include three hoses 2140-1, 2140-2 and 2140-3, and each of the hoses may receive processing liquids from different chemical supply sources P1, P2 and P3, respectively. One end of the three hoses 2140-1, 2140-2 and 2140-3 is connected to the first flange 2120, and the other end of the three hoses 2140-1, 2140-2 and 2140-3 is combined into one and then connected to the second flange 2130.

The first flange 2120 may have inlets 2122-1, 2122-2 and 2122-3 for introducing processing liquids into each of the hoses. Although not illustrated, the first flange 2120 may provide a flow path connecting the inlet 2122-1, 2122-2 and 2122-3 to the hoses 2140-1, 2140-2 and 2140-3. The second flange 2130 may have an outlet 2132 through which the processing liquid mixed from the hoses 2140-1, 2140-2 and 2140-3 is discharged.

The foregoing detailed description illustrates the present invention. Further, the above content illustrates and describes the exemplary embodiment of the present invention, and the present invention can be used in various other combinations, modifications, and environments. That is, the foregoing content may be modified or corrected within the scope of the concept of the invention disclosed in the present specification, the scope equivalent to that of the disclosure, and/or the scope of the skill or knowledge in the art. The foregoing exemplary embodiment describes the best state for implementing the technical spirit of the present invention, and various changes required in specific application fields and uses of the present invention are possible. Accordingly, the detailed description of the invention above is not intended to limit the invention to the disclosed exemplary embodiment. Further, the accompanying claims should be construed to include other exemplary embodiments as well.

What is claimed is:

1. A torsion pump, comprising:

a tube member having a hose communicating with a chemical liquid inlet and a chemical liquid outlet forming an open path from the chemical liquid inlet to the chemical liquid outlet through the hose, and a cylindrical drum provided to wind the hose, and configured to discharge a chemical liquid through a volume change caused by contraction of the hose wound around the drum; and a driver configured to provide a rotational force such that the hose is wound around the drums, wherein the tube member includes a first flange configured to support one end of the drum; and a second flange configured to support another end of the drum, wherein one end of the hose is connected to the first flange, and another end of the hose is connected to the second flange, wherein the second flange is connected to the driver and rotated, wherein the driver further includes a compensation member configured to compensate for a vertical length deformation caused by a twisting operation of the tube member, wherein the compensation member includes a bell screw, and wherein the second flange can rotate and move up and down on the ball screw.

2. The torsion pump of claim 1, wherein the first flange is provided with the chemical liquid inlet, and a first inner flow path connecting the chemical liquid inlet and the one end of the hose, and the second flange is provided with the chemical liquid outlet and a second inner flow path connecting the chemical liquid outlet and the another end of the hose.

3. The torsion pump of claim 2, wherein the tube member is provided with a plurality of hoses, and the hoses are wound in the same direction, and the hoses are provided with a chemical liquid from different chemical liquid sources and are combined into one hose before discharging the chemical liquid to the chemical liquid outlet.

4. The torsion pump of claim 1, wherein the hose is provided while being wound around the drum in a coil shape.

5. The torsion pump of claim 1, wherein the hose is wound around the drum in a coil shape by a winding operation of the driver.

6. The torsion pump of claim 1, further comprising a sealing case provided between the first flange and the second flange such that the drum and the hose are blocked from an external environment.

7. The torsion pump of claim 6, wherein an interior of the sealing case is filled with incompressible fluid, and the sealing case is provided in the form of bellows.

8. The torsion pump of claim 1, wherein the drum is made of a flexible material, and the drum provides an inner space connecting the chemical liquid inlet and the chemical liquid outlet, and is twisted by a rotation of a second flange, wherein the chemical liquid can be discharged through a volume change due to the twisting.

9. An apparatus for supplying a chemical liquid, the apparatus comprising:

a pump configured to supply the chemical liquid to a nozzle that discharges the chemical liquid to a substrate;

a trap tank in which the chemical liquid to be supplied from the pump to the nozzle is temporarily stored;

a bottle containing the chemical liquid stored in the trap tank;

a filter provided on a path through which the chemical liquid is supplied from the trap tank to the pump;

wherein the pump includes a tube member having at least one hose communicating with a chemical liquid inlet and a chemical liquid outlet forming an open path from the chemical liquid inlet to the chemical liquid outlet through the at least one hose, and a cylindrical drum provided to wind the at least one hose, and configured to discharge a chemical liquid through a volume change caused by contraction of the at least one hose wound around the drum; and a driver configured to provide a rotational force such that the at least one hose is wound around the drum, wherein the tube member includes a first flange configured to support one end of the drum; and a second flange configured to support another end of the drum, wherein one end of each of the at least one hose is connected to the first flange, and another end of each of the at least one hose is connected to the second flange, wherein the second flange is connected to the driver and rotated, wherein the driver further includes a compensation member configured to compensate for a vertical length deformation caused by a twisting operation of the tube member, wherein the compensation member includes a ball screw, and wherein the second flange can rotate and move up and down on the ball screw.

10. The apparatus for supplying the chemical liquid of claim 9, wherein the first flange is provided with the chemical liquid inlet, and a first inner flow path connecting the chemical liquid inlet and the one end of each of the at least one hose, and the second flange is provided with the chemical liquid outlet and a second inner flow path connecting the chemical liquid outlet and the another end of each of the at least one hose.

11. The apparatus for supplying the chemical liquid of claim 9, wherein the at least one hose is provided while being wound around the drum in a coil shape, or is provided to be wound around the drum in a coil shape by a winding operation of the driver.

12. The apparatus for supplying the chemical liquid of claim 9, further comprising a sealing case provided between the first flange and the second flange such that the drum and the at least one hose are blocked from an external environment.

13. The apparatus for supplying the chemical liquid of claim 12, wherein an interior of the sealing case is filled with incompressible fluid, and the sealing case is provided in the form of bellows.

14. The apparatus for supplying the chemical liquid of claim 9, wherein the drum is made of a flexible material, and the drum provides an inner space connecting the chemical liquid inlet and the chemical liquid outlet, and is twisted by a rotation of a second flange, wherein the chemical liquid can be discharged through a volume change due to the twisting.

15. A torsion pump, comprising:

a tube member having a hose communicating with a chemical liquid inlet and a chemical liquid outlet forming an open path from the chemical liquid inlet to the chemical liquid outlet through the hose, and a cylindrical drum provided to wind the hose, and configured to discharge a chemical liquid through a volume change caused by contraction of the hose wound around the drum; and a driver configured to provide a rotational force such that the hose is wound around the drum, wherein the tube member includes a first flange configured to support one end of the drum; and a second flange configured to support another end of the drum and connected to the driver and then rotated, and the torsion pump further comprises a sealing case provided between the first flange and the second flange such that the drum and the hose are blocked from an external environment, wherein one end of the hose is connected to the first flange, and another end of the hose is connected to the second flange, the first flange is provided with the chemical liquid inlet, and a first inner flow path connecting the chemical liquid inlet and the one end of the hose, and the second flange is provided with the chemical liquid outlet, and a second inner flow path connecting the chemical liquid outlet and the another end of the hose, wherein the driver further includes a compensation member configured to compensate for a vertical length deformation caused by a twisting operation of the tube member, wherein the compensation member includes a ball screw, and wherein the second flange can rotate and move up and down on the ball screw.

* * * * *